US010731436B2

(12) United States Patent
Allen et al.

(10) Patent No.: US 10,731,436 B2
(45) Date of Patent: Aug. 4, 2020

(54) BALL INJECTOR FOR FRAC TREE

(71) Applicant: Stream-Flo Industries Ltd., Edmonton (CA)

(72) Inventors: Gregory Wayne Allen, Seba Beach (CA); Keith David Farquharson, Edmonton (CA); Dean Ashley Beblow, St. Albert (CA); Glen Murray Eleniak, Ardrossan (CA); Jerry Wakeford, Sherwood Park (CA)

(73) Assignee: Stream-Flo Industries Ltd., Edmonton (CA)

( * ) Notice: Subject to any disclaimer, the term of this patent is extended or adjusted under 35 U.S.C. 154(b) by 73 days.

(21) Appl. No.: 16/195,642

(22) Filed: Nov. 19, 2018

(65) Prior Publication Data

US 2019/0085657 A1 Mar. 21, 2019

Related U.S. Application Data

(62) Division of application No. 15/059,033, filed on Mar. 2, 2016, now Pat. No. 10,161,218.
(Continued)

(51) Int. Cl.
*E21B 33/068* (2006.01)
*E21B 34/02* (2006.01)
(Continued)

(52) U.S. Cl.
CPC ..... *E21B 34/02* (2013.01); *E21B 43/26* (2013.01); *E21B 2034/002* (2013.01)

(58) Field of Classification Search
CPC ..... E21B 33/068; E21B 33/05; E21B 33/16
See application file for complete search history.

(56) References Cited

U.S. PATENT DOCUMENTS 2,790,500 A 4/1957 Jones
2,955,654 A 10/1960 Stognerjoel
(Continued)

FOREIGN PATENT DOCUMENTS

CA 2818250 12/2014
CA 2953695 2/2017

*Primary Examiner* — Kipp C Wallace
(74) *Attorney, Agent, or Firm* — Leydig, Voit & Mayer, Ltd.

(57) ABSTRACT

A ball injector for connecting below the frac head of a frac tree to accommodate and sequentially drop a ball into the axial passageway of the frac tree. The ball injector has an axial passage of an injector housing aligned with the axial passageway of the frac tree. A ball cartridge assembly stores one or more balls and sequentially delivers one ball to a port in the ball cartridge assembly. A ball launch side arm extends from the injector housing and forms a ball launch passageway communicating between the ball cartridge port and the axial passage. A first valve member in the ball launch passageway is opened to pass the ball into the axial passage, and is closed to isolate the ball cartridge assembly from a pressure in the axial passage. A second valve member between the first valve member and the ball cartridge assembly may be included to form a pressure isolation chamber between the valve members. Embodiments of ball cartridge assemblies to horizontally store a plurality of balls is provided. Also provided is a method of delivering a ball into a frac tree below the frac head, and a method of delivering and monitoring a ball progression into the frac tree, for example with a camera.

27 Claims, 18 Drawing Sheets

Related U.S. Application Data

(60) Provisional application No. 62/127,680, filed on Mar. 3, 2015.

(51) Int. Cl.
*E21B 43/26* (2006.01)
*E21B 34/00* (2006.01)

(56) References Cited

U.S. PATENT DOCUMENTS 2,961,045 A 11/1960 Stognerjoel
2,961,046 A 11/1960 Moeller
3,039,531 A 6/1962 Scott
3,063,080 A 11/1962 Bergman et al.
3,322,140 A 5/1967 Scott
3,403,729 A 10/1968 Hickey
3,951,208 A 4/1976 Delano
4,132,243 A 1/1979 Kuus
4,491,177 A 1/1985 Baugh
5,095,988 A * 3/1992 Bode ..... E21B 21/10 137/268
5,960,881 A 10/1999 Allamon et al.
6,079,074 A 6/2000 Ellett
6,182,752 B1 2/2001 Smith, Jr. et al.
6,302,199 B1 10/2001 Hawkins et al.
7,364,051 B2 4/2008 Diaz et al.
7,537,052 B2 5/2009 Robichaux et al.
7,552,763 B2 6/2009 Claxton
7,571,773 B1 8/2009 West et al.
8,136,585 B2 3/2012 Cherewyk
8,196,650 B1 6/2012 Robichaux et al.
8,256,514 B2 9/2012 Winzer
8,356,661 B1 1/2013 Robichaux et al.
8,561,684 B2 10/2013 Winzer
8,590,611 B2 11/2013 Callouet et al.
8,636,055 B2 1/2014 Young et al.
8,839,851 B2 9/2014 Young et al.
8,869,882 B2 10/2014 McGuire et al.
8,869,883 B2 10/2014 McGuire et al.
8,893,773 B2 11/2014 Robichaux et al.
9,010,412 B2 4/2015 McGuire
9,010,413 B2 4/2015 Artherholt et al.
9,027,652 B2 5/2015 Cherewyk
9,103,183 B2 8/2015 He et al.
9,109,422 B2 8/2015 Ferguson et al.
9,115,562 B2 8/2015 Guidry et al.
9,222,329 B2 12/2015 McGuire et al.
9,228,417 B2 1/2016 McGuire et al.
9,260,933 B2 2/2016 Artherholt et al.
9,291,024 B2 3/2016 Artherholt et al.
9,291,025 B2 3/2016 McGuire
2003/0192690 A1 10/2003 Carlson
2006/0124305 A1 6/2006 Juhasz
2008/0223587 A1 9/2008 Cherewyk
2013/0014936 A1 1/2013 Griffith
2013/0032327 A1 2/2013 He
2013/0228326 A1 9/2013 Griffith et al.
2014/0102717 A1 4/2014 Cherewyk
2014/0262302 A1 9/2014 Ferguson et al.
2014/0360720 A1 12/2014 Corbeil
2015/0000893 A1 1/2015 Young et al.
2015/0021011 A1 1/2015 Bihun et al.
2015/0021024 A1 1/2015 Artherholt et al.
2017/0051572 A1 2/2017 Penney et al.

* cited by examiner

BALL INJECTOR FOR FRAC TREE

CROSS-REFERENCE TO RELATED APPLICATION

This application claims priority from U.S. patent application Ser. No. 15/059,033, filed Mar. 2, 2016, and U.S. Provisional Patent Application No. 62/127,680 filed Mar. 3, 2015, which are incorporated by reference herein to the extent that there is no inconsistency with the present disclosure.

FIELD OF THE INVENTION

This invention relates in general to hydrocarbon well stimulation equipment for downhole fracturing and, in particular, to a ball injector to deliver one or more balls into a frac tree, to a method of injecting a ball into the axial passageway of a frac tree, to a ball cartridge assembly for storing and sequentially delivering balls, and to a frac tree including a ball injector.

BACKGROUND

Current methods for completing hydrocarbon wells often involve isolating zones of interest using packers, cement and the like, and pumping fracturing fluids into the wellbore to stimulate one or more production zones of a well. For example, the casing of a cased wellbore may be perforated to allow oil and/or gas to enter the wellbore and fracturing fluid may be pumped into the wellbore through the perforations into the formation. For open uncased wellbores, stimulation may be carried out directly in the zones. The downhole completion equipment may use downhole tools such as ball-actuated frac sleeves, which may be arranged in series. The frac sleeves have side ports that block fluid access to a production zone with which it is associated until an appropriately sized ball is pumped down from the surface to open the sleeve. The ball lands on a ball seat in the ball-actuated frac sleeve and frac fluid pressure on the ball forces the side ports in the frac sleeve to open and provide fluid access to that production zone. Other types of fracing operations, and other ball actuated downhole devices are well known in the art.

This process of hydraulic fracturing ("fracing") creates hydraulic fractures in rocks, with a goal to increase the output of a well. The hydraulic fracture is formed by pumping a fracturing fluid into the wellbore at a rate sufficient to increase the pressure downhole to a value in excess of the fracture gradient of the formation rock. The fracture fluid can be any number of fluids, ranging from water to gels, foams, nitrogen, carbon dioxide, or air in some cases. The pressure causes the formation to crack, allowing the fracturing fluid to enter and extend the crack further into the formation. To maintain the fractures open after injection stops, propping agents are introduced into the fracturing fluid and pumped into the fractures to extend the breaks and pack them with proppants, or small spheres generally composed of quartz sand grains, ceramic spheres, or aluminum oxide pellets. The propped hydraulic fracture provides a high permeability conduit through which the formation fluids can flow to the well.

At the surface, hydraulic fracturing equipment for oil and natural gas fields usually includes frac tanks holding fracturing fluids and which are coupled through supply lines to a slurry blender, one or more high-pressure fracturing pumps to pump the fracturing fluid to the frac head of the well, and a monitoring unit. Fracturing equipment operates over a range of high pressures and injection rates. Many frac pumps are typically used at any given time to maintain the very high, required flow rates into the frac head and into the well.

An industry standard prior art fracturing tree ("frac tree") is typically mounted vertically above a wellhead and includes the frac head, sometimes termed a "pump block" or a "goat head", which is a large block of steel for injecting frac fluids. Since the frac head is mounted above the wellhead, it may be at an elevation of about 14-16 feet (about 5 meters) from the ground. The frac head includes multiple fluid inlets which are connected to supply lines to allow frac fluids to be combined from multiple supply lines into the central bore of the frac head. The combined flow of frac fluids is pumped under pressure downwardly through a bottom outlet of the frac tree into the central bore of the wellhead. Generally, the frac tree includes one or more master valves below the frac head, and above the bottom outlet. An axial passageway extends through the frac tree from the central bore of the frac head through the master valves to the bottom outlet. The axial passageway is generally a radial bore to accommodate radial balls being launched through the frac tree. A flow back tee, is typically a standard component of a frac tree. The flow back tee accommodates fluids flowing back through the frac tree for diversion through the one or more valved side arms. For instance, a ball catch device may be connected to one of the side arms for balls being returned from the wellbore through the wellhead.

To stimulate multiple zones in a single stimulation treatment, a series of packers in a packer arrangement is inserted into the wellbore, each of the packers being located at intervals for isolating one zone from an adjacent zone. A ball is introduced from the frac tree into the wellbore to selectively engage one of the packers in order to block fluid flow therethrough, permitting creation of an isolated zone uphole from the packer for subsequent treatment or stimulation. Once the isolated zone has been stimulated, a subsequent ball is dropped to engage a subsequent packer, above of the previously engaged packer, for isolation and stimulation thereabove. The process is continued until all the desired zones have been stimulated. Typically the balls range in diameter from a smallest ball, suitable to engage the most distant packer, to the largest diameter, suitable for engaging the packer located most proximate the surface. Other stimulating methods are known which involve dropping repeater balls of same or similar size.

Although the balls can theoretically be dropped through a surface valve, this is a slow process that is dangerous to operators if a mistake is made. Consequently, ball launch mechanisms for dropping or injecting balls sequentially in an appropriate size sequence into a frac fluid stream have been designed. However, such mechanisms are often subject to mechanical failure and/or operator error. As is well understood, a ball dropped out of sequence is undesirable because one or more zones are not fractured and the ball-actuated sleeves associated with those zones are left closed, so expensive remediation is required.

U.S. Pat. No. 8,636,055 issued Jan. 28, 2014 to Young et al., describes a ball drop system in which the balls are arranged vertically, on above another, with the smallest at the bottom and the largest at the top of a ball cartridge that is mounted above the frac head. The ball cartridge houses a ball rail having a bottom end that forms an aperture with an inner periphery of the ball cartridge through which balls of a ball stack supported by the ball rail are sequentially dropped from the ball stack as a size of the aperture is increased by an aperture controller operatively connected to the ball rail. Depending on the number of balls needed for a system, this ball drop system adds excessive height to the overall frac tree, raising safety issues and making it difficult and costly to service and install. As well, when exposed to the high pressures of the frac tree system, and coupled with the extreme freezing temperatures during use, the balls may fail to release when the aperture is opened.

When operational problems occur, such as malfunctioning valves or balls becoming stuck and not being pumped downhole, these problems may result in failed well treatment operations, requiring costly and inefficient re-working. At times re-working or re-stimulating of a well formation following an unsuccessful stimulation treatment may not be successful, resulting in a production loss.

Another technique to introduce balls involves an array of remote valves positioned onto a multi-port connection at the wellhead with a single ball positioned behind each valve. Each valve requires a separate manifold fluid pumper line and precise coordination both to ensure the ball is deployed and to ensure each ball is deployed at the right time in the sequence, throughout the stimulation operation. The multi-port arrangement requires multiple high pressure valves and other equipment, increasing the capital costs for the frac operation. The multiplicity of high pressure lines also logistically limits the number of balls that can be dropped due to wellhead design and available ports without re-loading. U.S. Patent Application Publication No. 2014/0262302 to Ferguson et al. discloses a system of this nature. The balls are individually pumped directly into the frac head where high turbulence may damage the balls. As well, larger packer balls generally need to be launched from above the frac tree, making the launch more complicated.

Applicant's previously patented ball drop system is described in U.S. Pat. Nos. 8,256,514 and 8,561,684 to Winzer. The ball drop system includes a vertically stacked manifold 40 of pre-loaded balls oriented in a vertical stack in a bore which is axially aligned above the main axial passageway of the frac head. Each ball is temporarily supported in the bore by a rod. Each rod is sequentially actuated to withdraw from the bore when required to release or launch the next largest ball. The lowest ball (closest to the wellbore of the wellhead) is typically the smallest ball, although same sized balls may be loaded.

U.S. Patent Publication No. 2014/0360720 to Corbeil describes a ball drop system mounted above a wellhead assembly. The balls are loaded in a vertical stack in an manifold, with each ball temporarily supported on a hinged pin for sequential dropping into the bore of the wellhead assembly. The wellhead assembly includes ball launch valves above and below a staging assembly to allow the balls to be sequentially dropped into the wellhead located therebelow, while maintaining the ball injector at atmospheric pressure.

In the above systems, if a ball is damaged or disintegrates upon arrival at the downhole tool, a replacement ball or one of the same diameter must be reloaded and launched again. If the ball drop system is pressurized, as it is for most of the prior art systems, the entire apparatus must be depressurized, removed and reloaded to get a smaller ball under the remaining loaded balls. Due to the size, weight and height of these systems, this is a time consuming and costly process, and must be carefully managed to maintain safe control in a hazardous environment and to complete testing and re-pressurization procedures upon reinstallation to the wellhead. The Corbeil system includes further wellhead valves and staging equipment in the vertical stack above the wellhead, adding height and safety concerns as mentioned above, as well as still requiring individual ball launch mechanisms to be provided and engaged for each individual ball, adding to costs and the possibility of an unsuccessful ball launch.

It is also important to note that the fracturing operations involve a large number of trucks, pumps, containers, hoses or other conduits, and other equipment for a fracturing system. In practice, many trucks and pumps are used to provide the cumulative amounts of fluid for the well at a well site which are moved from well to well. The difficulty of working around the wells with the large number of components also causes safety issues. The number of assembled equipment components raises the complexity of the system and the ability to operate in and around the multiple wells. Improvements are needed in a ball launch system to simplify the complexity of the system at the frac head. There remains a need for a safe, efficient and remotely operated apparatus to introducing balls to a wellbore.

SUMMARY OF THE INVENTION

Broadly provided is a ball injector is provided for connecting to a pressure-containing frac tree and accommodating a ball from one or more balls to be sequentially dropped by the ball injector through a main axial passageway of the frac tree, the frac tree being of the type having a frac head into which frac fluids are pumped under pressure, one or more master valves below the frac head, optionally a flow back tee between the frac head and the one or more master valves, and a wellhead connector at the bottom of the frac tree to connect to a wellhead, the main axial passageway extending generally vertically through the frac head, the one or more master valves and the optional flow back tee. The ball injector includes a pressure-containing injector housing having a top end portion and a bottom end portion and an axial passage extending from the top end portion to the bottom end portion, the top end portion and the bottom end portion being adapted to connect the injector housing into the frac tree below the frac head and above the wellhead connector such that the axial passage is aligned with the main axial passageway of the frac tree. A ball cartridge assembly stores the one or more balls to sequentially deliver one of the balls to a port in the ball cartridge assembly. A ball launch side arm extends from the injector housing and forms a ball launch passageway communicating between the port of the ball cartridge assembly and the axial passage for passage of the ball from the ball cartridge assembly to the axial passage. A first valve member is provided in the ball launch passageway to pass the ball into the axial passage in an open position and to isolate the ball cartridge assembly and the ball launch passageway from a pressure in the axial passage in a closed position.

In some embodiments, the ball injector includes a ball drive assembly to drive the ball through the ball launch passageway and through the first valve member. In some embodiments, the ball drive assembly may include a push rod to drive the ball into the axial passageway.

In some embodiments, the ball injector further includes a second valve member in the ball launch passageway between the first valve member and the ball cartridge assembly so as to form a pressure isolation chamber in the ball launch passageway between the first valve member and the second valve member. When the first valve member and the second valve members are both in a closed position, the ball cartridge assembly and the pressure isolation chamber are isolated from the pressure in the axial passage. When the second valve member is in an open position and the first valve member is in the closed position, the ball may be delivered from the ball cartridge assembly through the second valve member into the pressure isolation chamber. When the second valve member is in the closed position and the first valve member is in the open position the ball may be driven by the ball drive assembly through the pressure isolation chamber and through the first valve member into the axial passage while the ball cartridge assembly remains isolated from the pressure of the axial passage.

In some embodiments, a first portion of the ball launch passageway extending through the pressure isolation chamber and through the open position of the first valve member to the axial passage is axially aligned along a first axis, and a second portion of the ball launch passageway extending through the pressure isolation chamber and through the open position of the second valve member to the port of the ball cartridge assembly is axially aligned along a second axis which intersects the first axis within the pressure isolation chamber. The push rod may be driven along the first axis to deliver the ball to the axial passage.

In some embodiments, the ball injector includes a pressure adjustment system connected to the pressure isolation chamber to adjust the pressure across one or both of the first valve member and the second valve member.

Broadly provided is a method of delivering a ball to the main axial passageway of a pressure-containing frac tree is provided. The method includes:

a) supporting one or more balls in a ball cartridge assembly for sequential delivery to a port in a ball cartridge assembly;

b) connecting a ball injector into the frac tree at a position below a frac head of the frac tree such that an axial passage of the ball injector is axially aligned with the main axial passageway of the frac tree, and such that a ball launch side arm of the ball injector forms a ball launch passageway extending from the axial passage to the port of the ball cartridge assembly;

c) delivering one of the one or more balls to the port in the ball cartridge assembly;

d) opening a first valve member in the ball launch passageway from an initially closed position to allow the one ball to be delivered from the port into the ball launch passageway and to be delivered through the first valve member into the axial passage to be delivered into the main axial passageway of the frac tree;

e) closing the first valve member to isolate the ball cartridge assembly and the portion of the ball launch passageway between the first valve member and the ball cartridge assembly from a pressure in the axial passage; and f) repeating steps c) to e) for each subsequent one ball of the one or more balls sequentially delivered to the port of the ball cartridge assembly.

In some embodiments, the method includes, after each step d), driving the one ball through the ball launch passageway and through the first valve member, for example with a push rod, into the axial passageway, without limiting flow in the axial passage.

In some embodiments, the method further includes, before each step d):

i. opening a second valve member in the ball launch passageway positioned between the first valve member and the ball cartridge assembly while the first valve member is in the initially closed position to allow the one of the plurality of balls to be delivered from the port into a pressure isolation chamber of the ball launch passageway formed between the first valve member and the second valve member; and ii. closing the second valve member such that the ball cartridge assembly is isolated from the pressure of the axial passage when the first valve member is subsequently opened.

Also broadly provided are embodiments of a ball cartridge assembly for storing the balls in a generally horizontal position.

Broadly provided is a method of delivering a ball to the main axial passageway of a pressure-containing frac tree. The method includes:

a) supporting and housing one or more balls in a ball cartridge assembly for sequential delivery to a ball launch position at a port in the ball cartridge assembly such that the one or more balls in a supported and housed position provide an unobstructed view or access to the port;

b) providing a sensor above or at the port;

c) connecting a ball injector between the ball cartridge assembly and the frac tree such that an axial passage of the ball injector is axially aligned with the main axial passageway of the frac tree;

d) providing a ball launch passageway extending from the axial passage to the port of the ball cartridge assembly, the ball launch passageway forming a pressure isolation chamber between a first valve member and a second valve member with the first valve member being positioned more proximate the axial passage than the second valve member, a first portion of the ball launch passageway extending through the pressure isolation chamber and through the open position of the first valve member to the axial passage is axially aligned along a first axis, and a second portion of the ball launch passageway extending through the pressure isolation chamber and through the open position of the second valve member to the port of the ball cartridge assembly is axially aligned along a second axis;

e) delivering one of the one or more balls to the port in the ball cartridge assembly;

f) with the first valve member in a closed position, opening the second valve member from an initially closed position to allow the one ball to be delivered from the port along the second axis through the second valve into the pressure isolation chamber;

g) with the sensor, monitoring the progression of the one ball from the port, along the second axis through the second valve member and into the pressure isolation chamber;

h) closing the second valve member to isolate the ball cartridge assembly from a pressure in the axial passage;

i) opening the first valve member to allow the one ball to be delivered from the pressure isolation chamber through the first valve member into the axial passage to be delivered to the main axial passageway of the frac tree; and j) repeating steps e) to i) for each subsequent one of the one or more balls sequentially delivered to the port of the ball cartridge assembly.

Although the term "ball" is used herein and in the claims, it is to be understood that the term broadly includes any activation device such as a ball, a drop plug or other shaped plugging device or element that may be used with a ball seat or other devices in one or more downhole tools capable of receiving a ball to activate the downhole tool, or to perform the required completion operation or other operation. For simplicity it is to be understood that the term "ball" includes and encompasses all shapes and sizes of plugs, balls, or drop plugs unless the specific shape or design of the "ball" is expressly discussed. As well, while the term "a ball" or "one ball" is used herein and in the claims, it is to be understood that these terms extend to a single ball, or to one group of balls to be dropped in one cycle of a ball drop.

BRIEF DESCRIPTION ON THE DRAWINGS

FIG. 1 is a side view of a prior art frac tree for mounting above a wellhead, and a prior art ball drop system as described generally above, and in greater detail in U.S. Pat. Nos. 8,256,514 and 8,561,684 to Winzer.

FIG. 2 side perspective view of a frac tree into which the ball injector of the present invention is mounted below the frac head, with a ball cartridge assembly and a ball drive assembly shown schematically.

FIG. 3 is a side sectional view of one embodiment of the ball injector in schematic detail, showing an injector housing formed with an axial passage to be aligned with the main axial passageway through the frac tree, and first and second valve members in a ball launch side arm extending from injector housing. A ball launch passageway extends from the ball cartridge assembly (not shown), through the valve members to the axial passage. In closed positions, the first and second valve members isolate a pressure isolation chamber between the first and second valve members. The first and second valve members are shown oriented along first and second axes intersecting within the pressure isolation chamber. A push rod component, shown in a withdrawn position, is aligned for reciprocating movement along the first axis, within a hydraulic cylinder.

Figure 3:
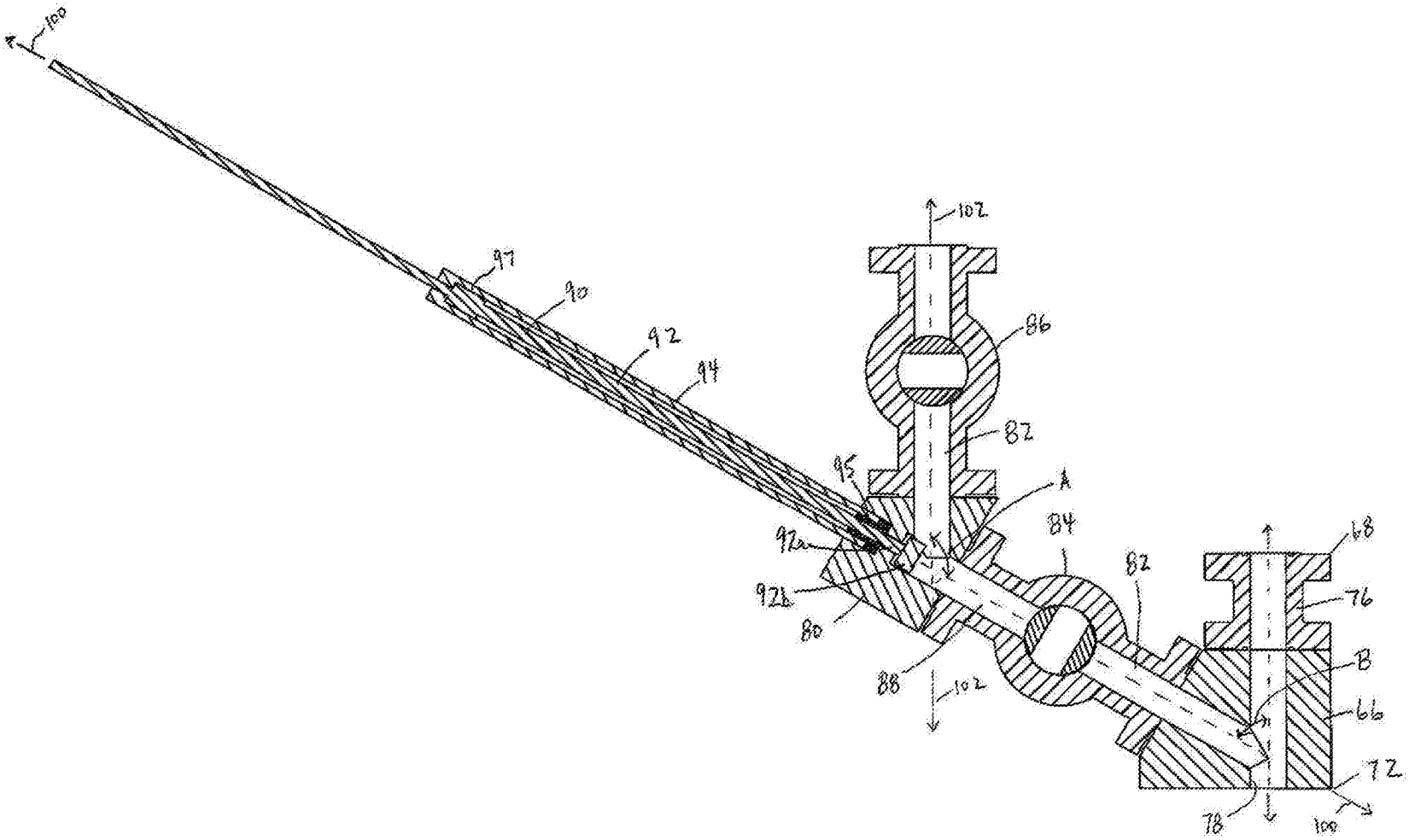
Figure 4:
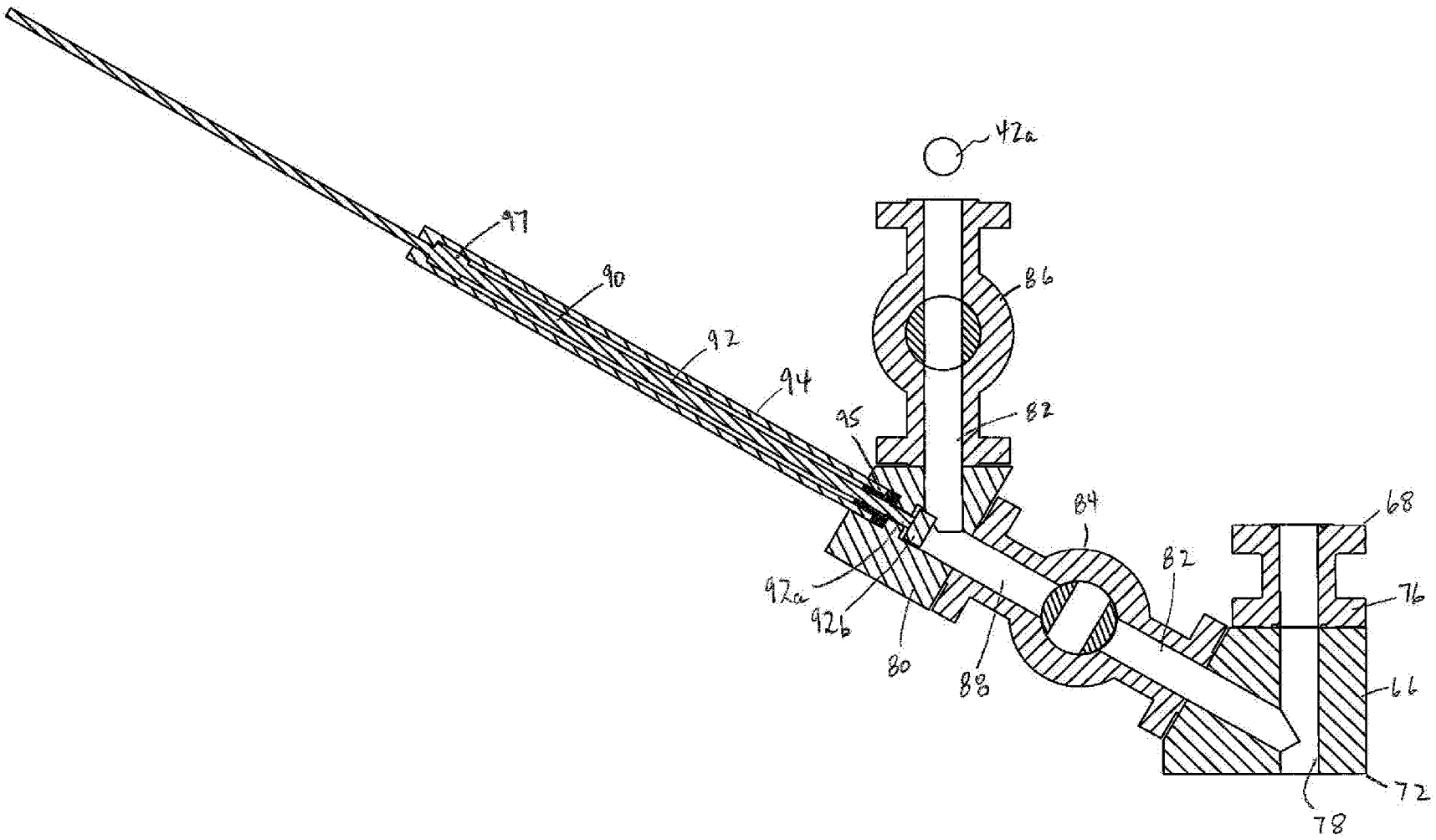
FIG. 4 is the sectional view of FIG. 3, showing one ball being launched, for example from the ball cartridge assembly of FIG. 2, with the second valve member in an open position so that the ball may drop through the second valve member.
Figure 5:
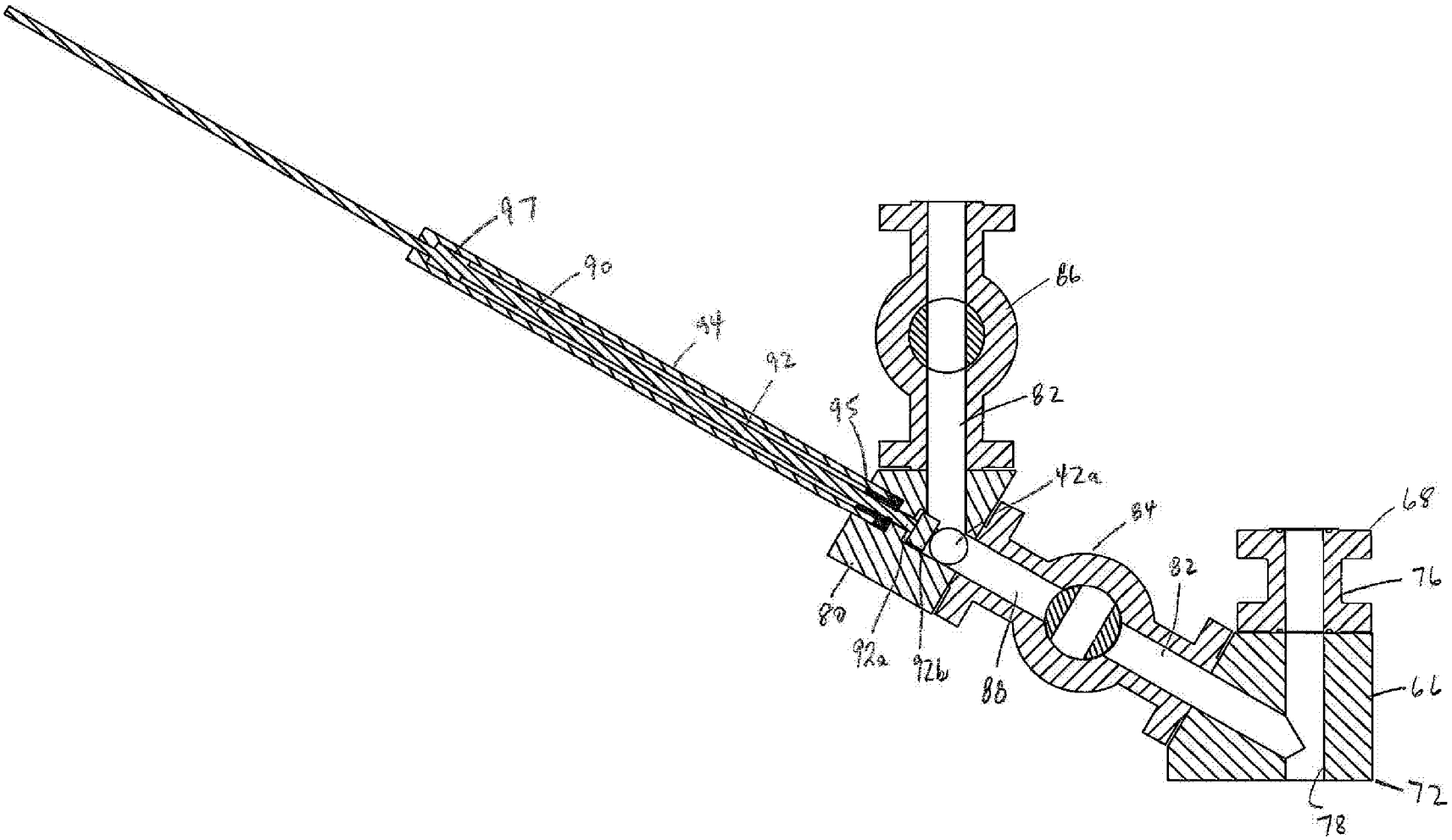
FIG. 5 is the sectional view of FIG. 3, showing the ball in the pressure isolation chamber of the ball launch passageway.
Figure 6:
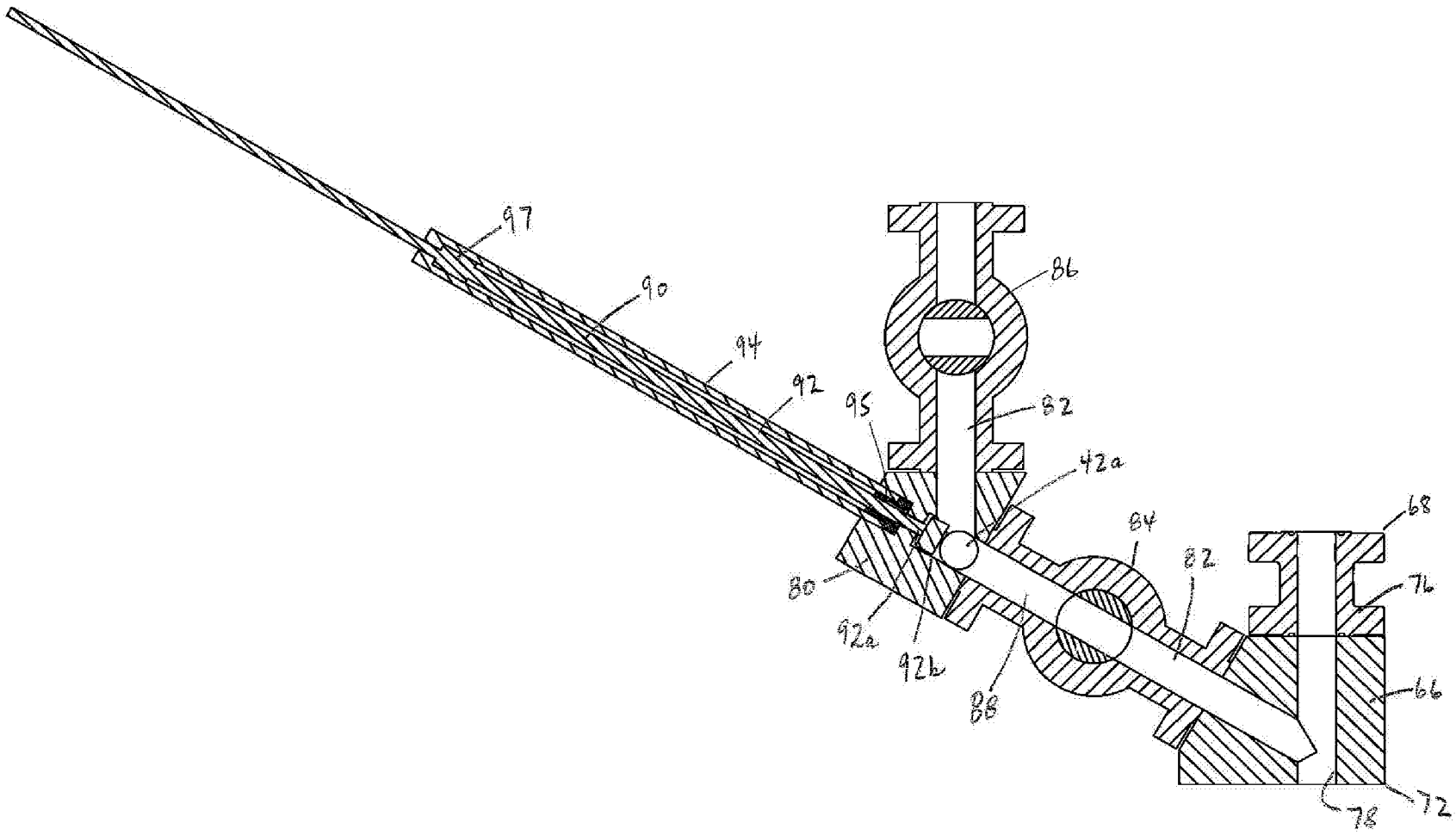
FIG. 6 is the sectional view of FIG. 3, showing the second valve member in a closed position and the first valve member in an open position communicating with the axial passage of the ball injector.
Figure 7:
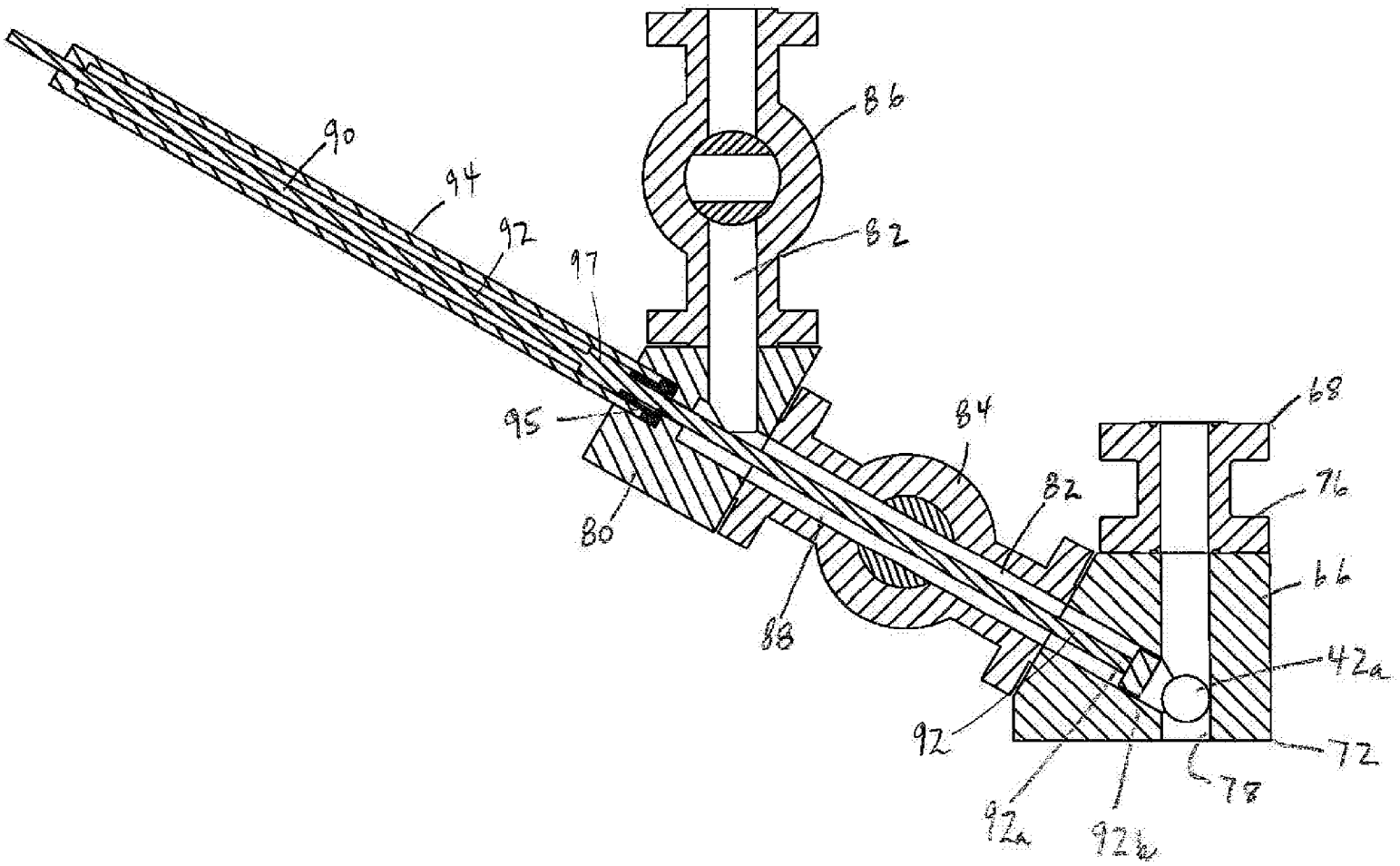
FIG. 7 is a sectional view of FIG. 3, showing the push rod in the extended position along the first axis of the ball launch passageway to drive the ball into the axial passage of the ball injector.
Figure 7A:
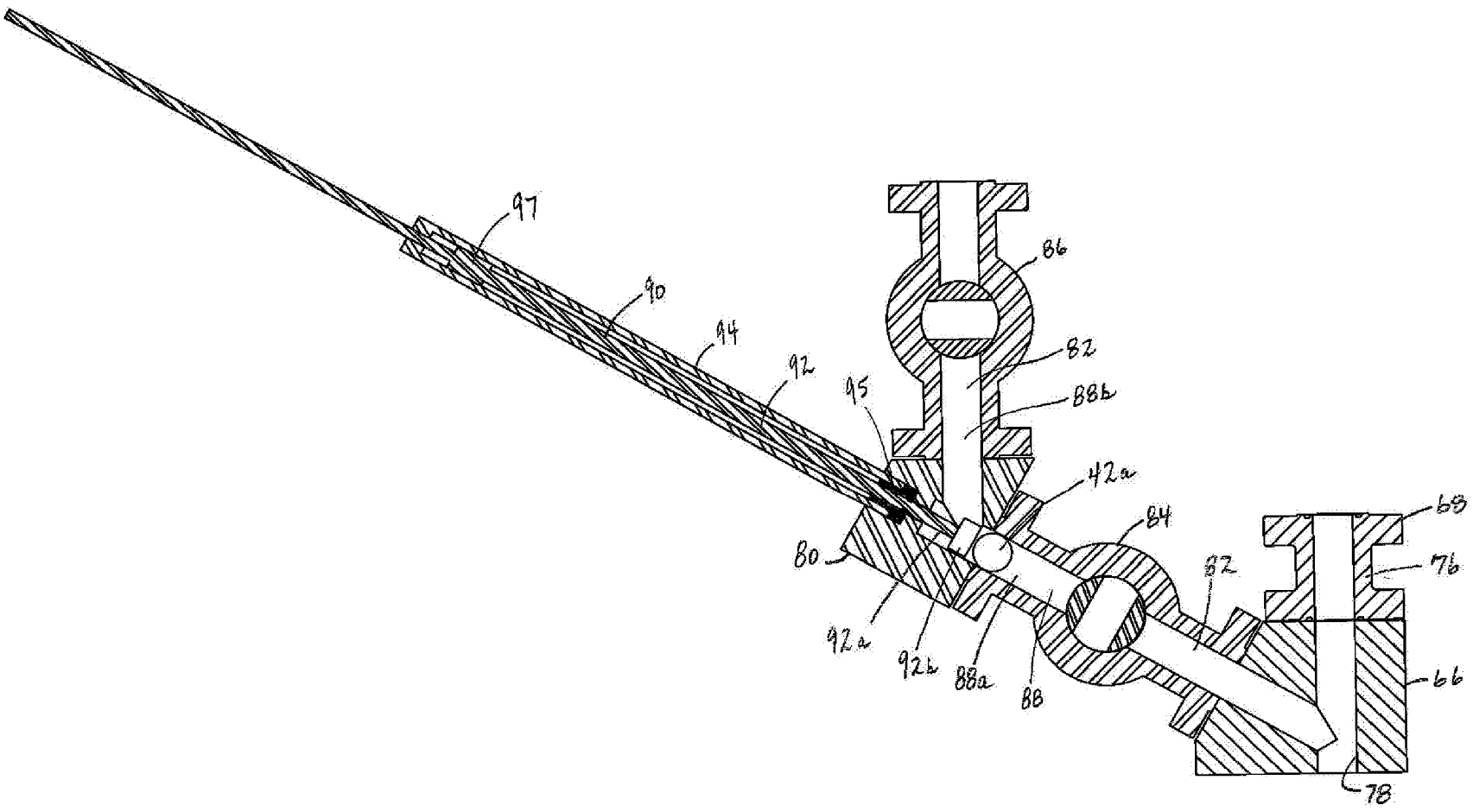

FIG. 7A is a section view of FIG. 3, showing an alternate embodiment of operating the ball injector with a step inserted between FIGS. 5 and 6, in which the ball is in the pressure isolation chamber of the ball launch passageway with the first and second valve members in the closed positions, and the ball is moved forwardly by the push rod toward the axial passage, such that a block at the forward, pushing end of the push rod prevents or blocks the ball from moving backwardly (or vertically) within the pressure isolation chamber toward the second valve member.

Figure 2:
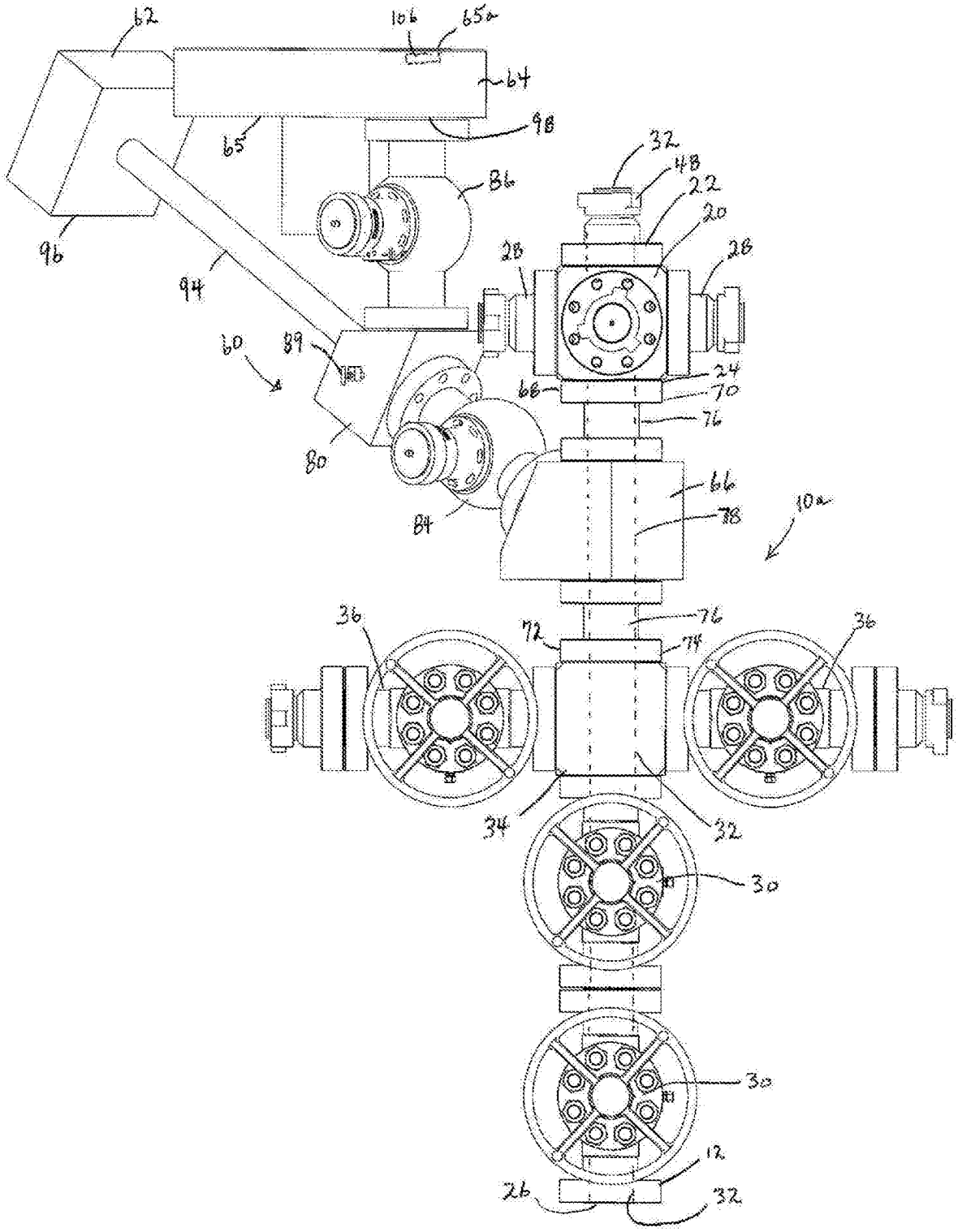
Figure 8:
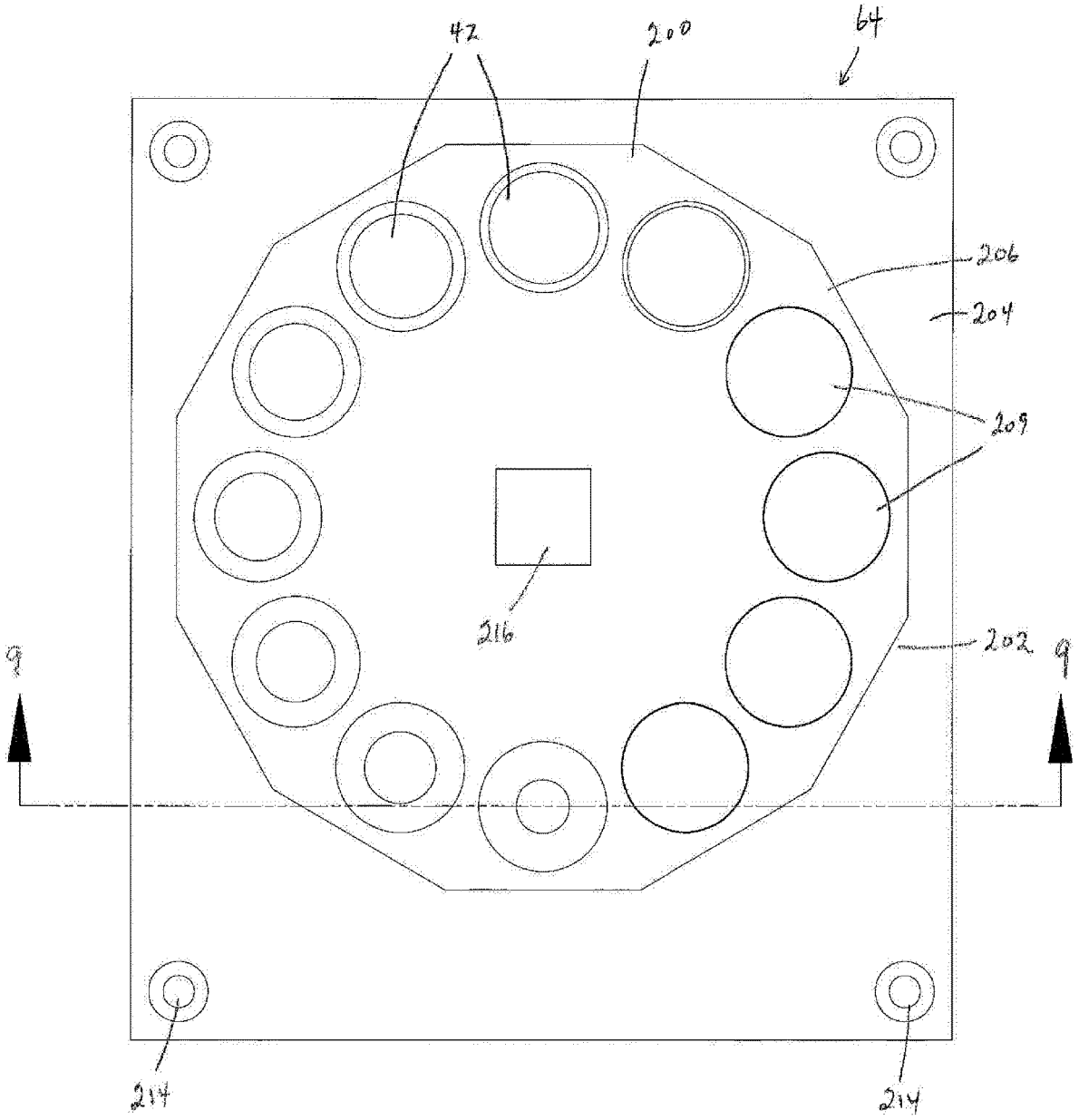

FIG. 8 is a top view of one embodiment of the ball cartridge assembly of FIG. 2, with the top cover removed to show a rotary carousel mechanism to hold a plurality of balls.

Figure 9:
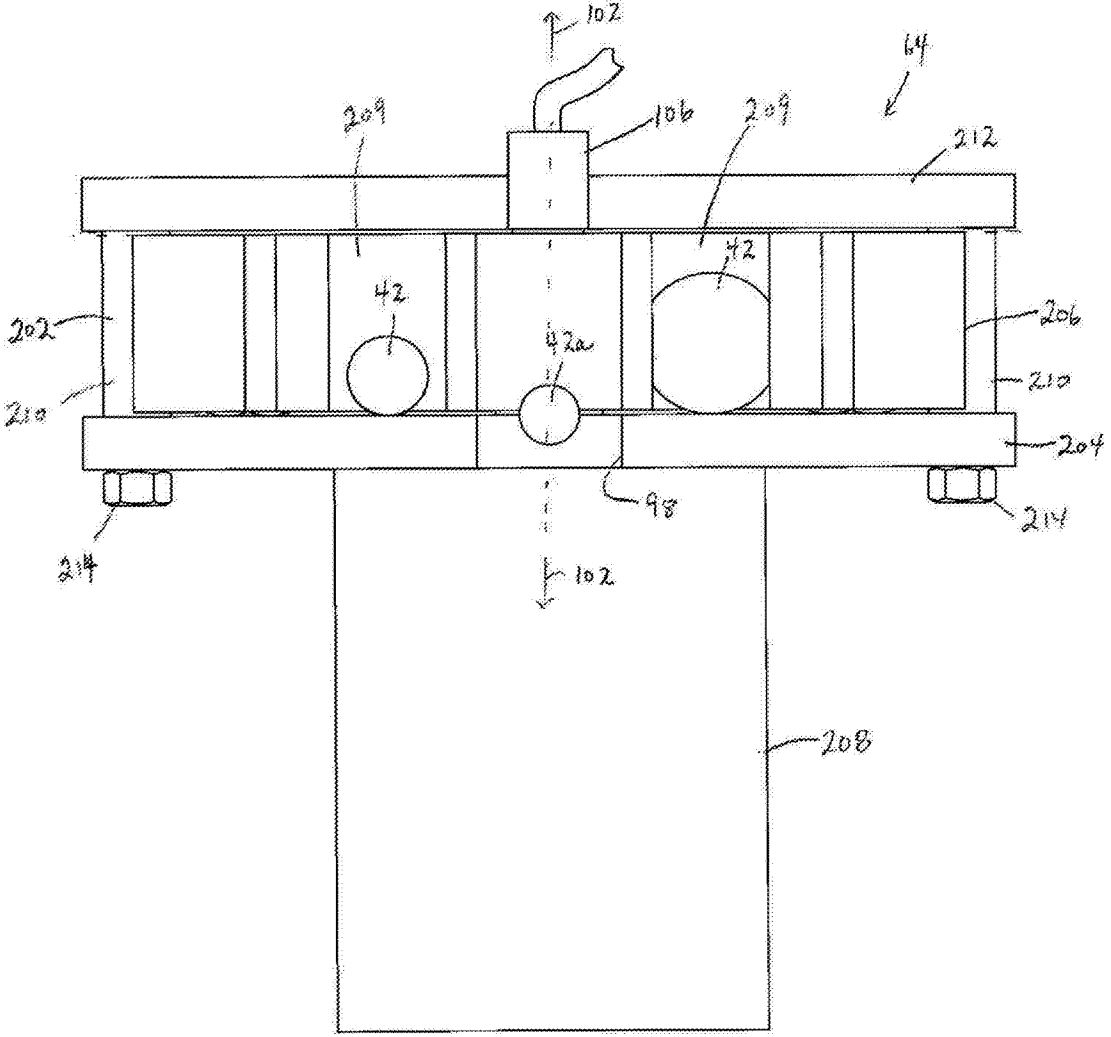

FIG. 9 is a sectional view taken along line 9-9 of FIG. 8 in which the balls are held horizontally and arranged in a rotary carousel for delivery to a port aligned with the second axis of ball isolation passageway, and showing a camera mounted in above the port for visual verification that the ball has been launched into the ball launch passageway.

Figure 10:
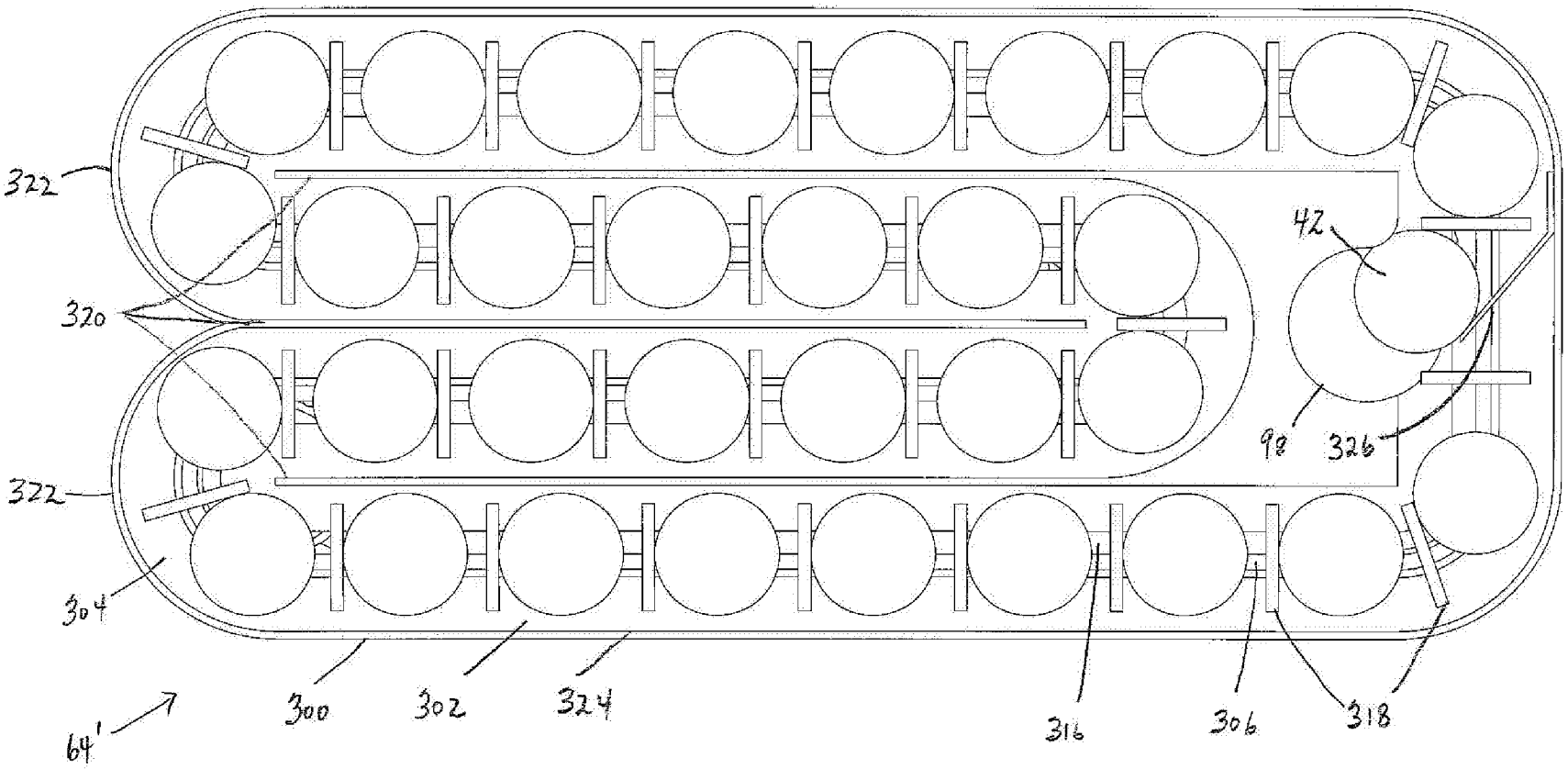

FIG. 10 is a top view of a second embodiment of the ball cartridge assembly of FIG. 2, in which a top cover is removed to show a driven chain mechanism for delivering the plurality of balls sequentially to a port aligned the second axis of the ball isolation passageway.

Figure 11:
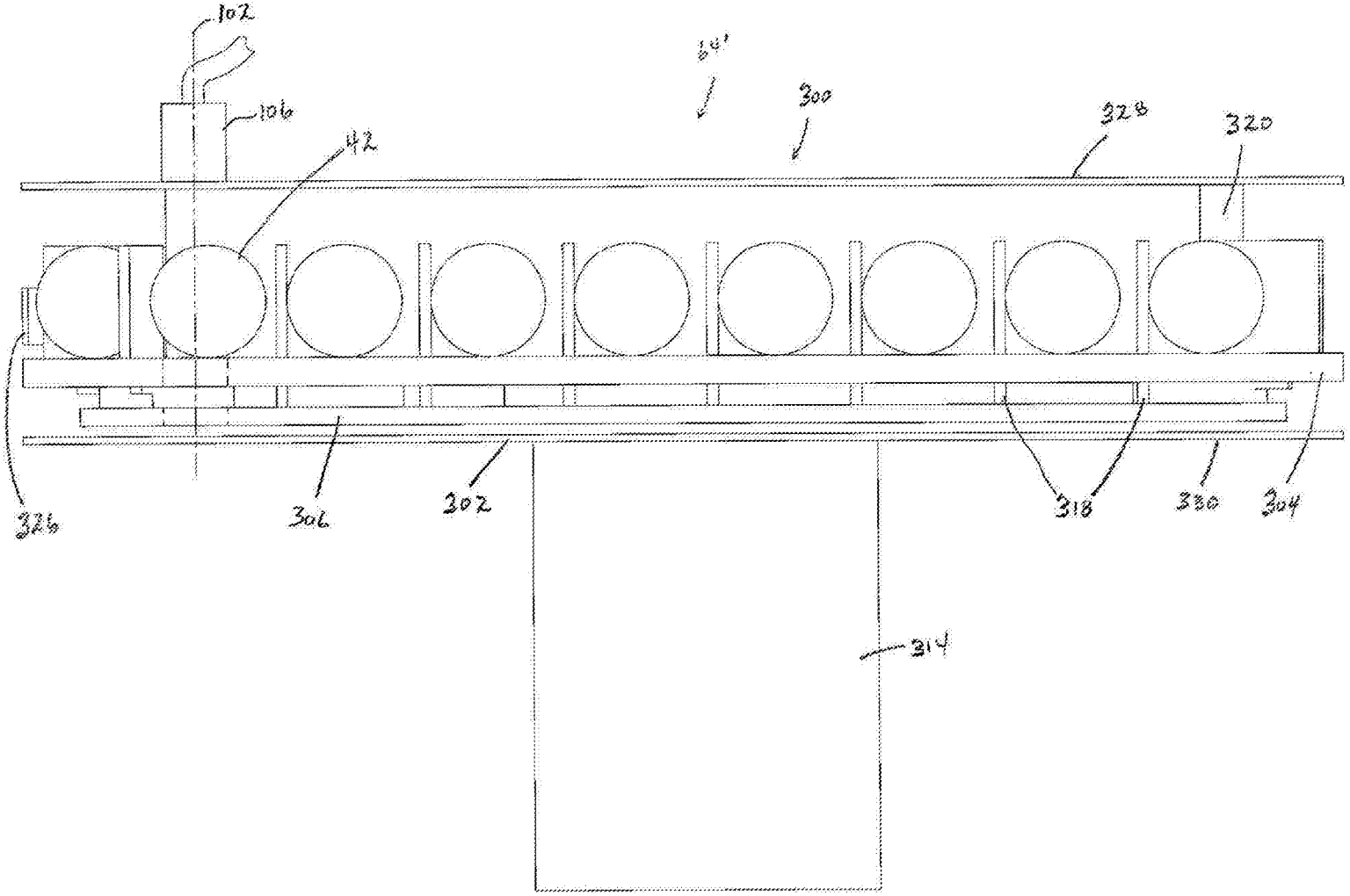

FIG. 11 is a side view of the ball cartridge assembly of FIG. 10 with a side wall removed.

Figure 12:
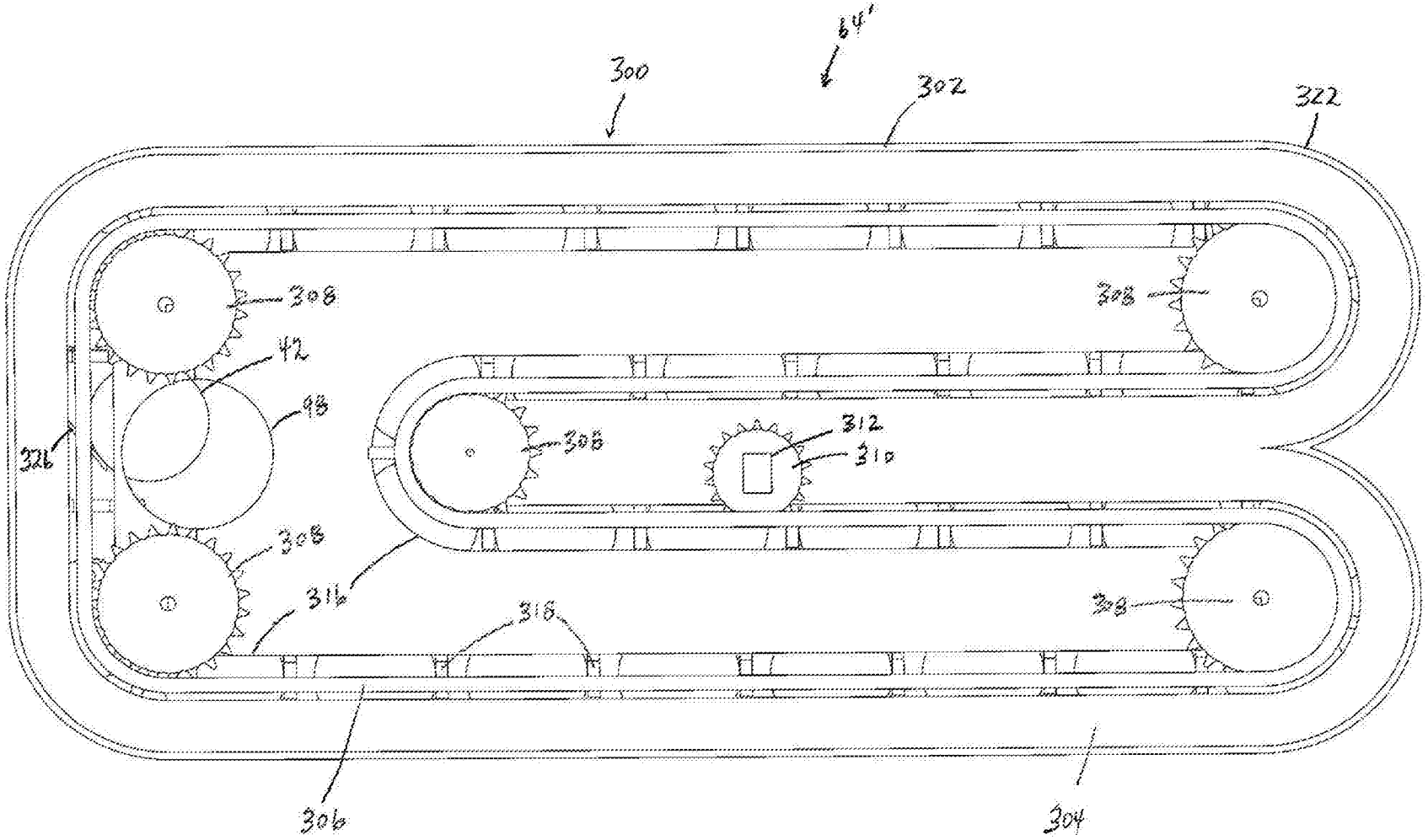

FIG. 12 is a bottom view of the ball cartridge assembly of FIG. 10 with the motor and bottom plate removed to show the details of the driven chain mechanism.

Figure 13:
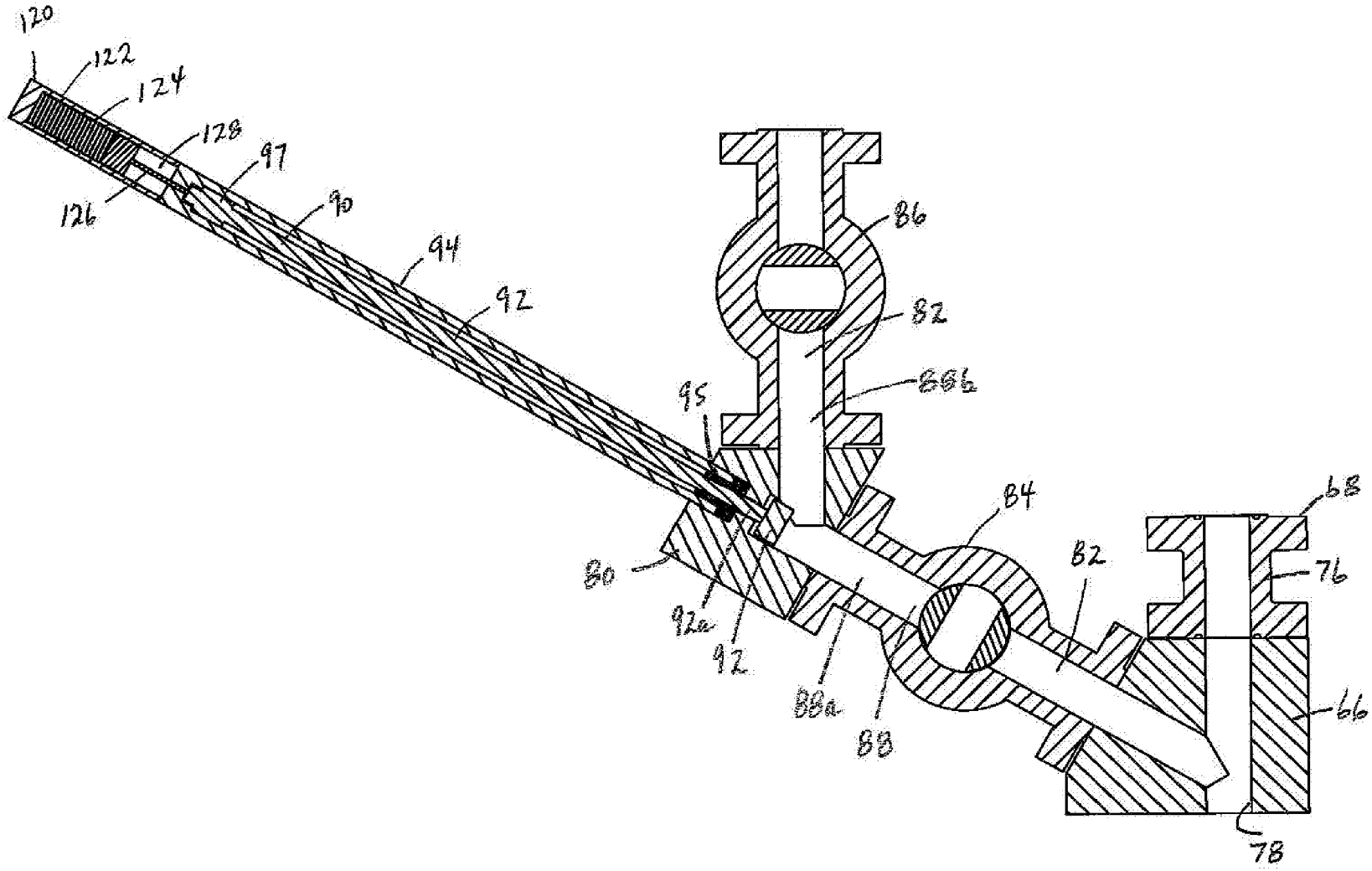

FIG. 13 is a sectional view of further embodiment of a ball injector, showing an alternate push rod/hydraulic cylinder arrangement with a spring mechanism to incrementally move the ball and push rod to the position shown in FIG. 7A, with visual indicator windows for monitoring the progression and position of push rod.

Figure 14:
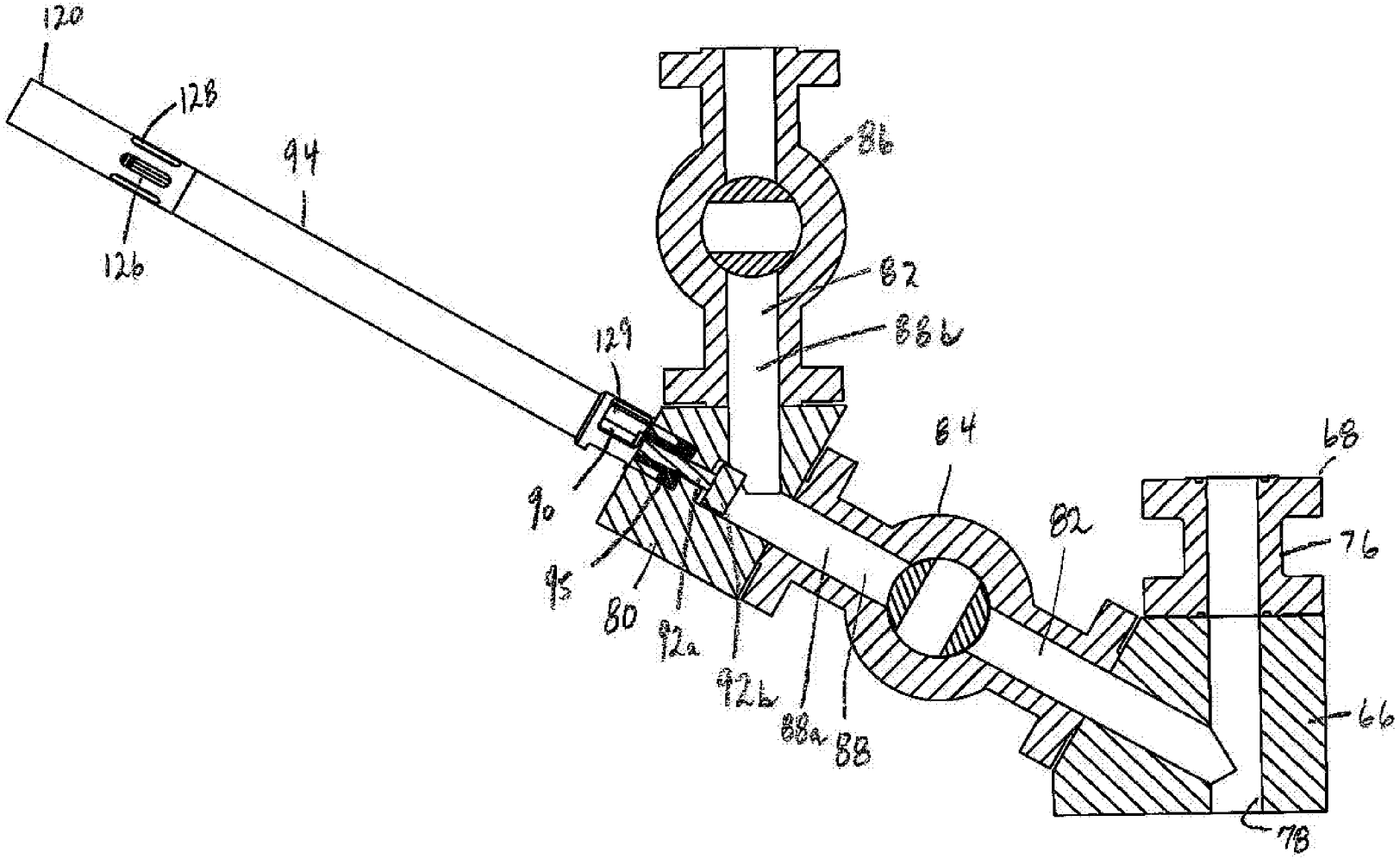

FIG. 14 is the sectional view of FIG. 13, but showing the push rod/hydraulic cylinder arrangement as a side view to show the visual indicator windows at both ends of the hydraulic cylinder.

Figure 15:
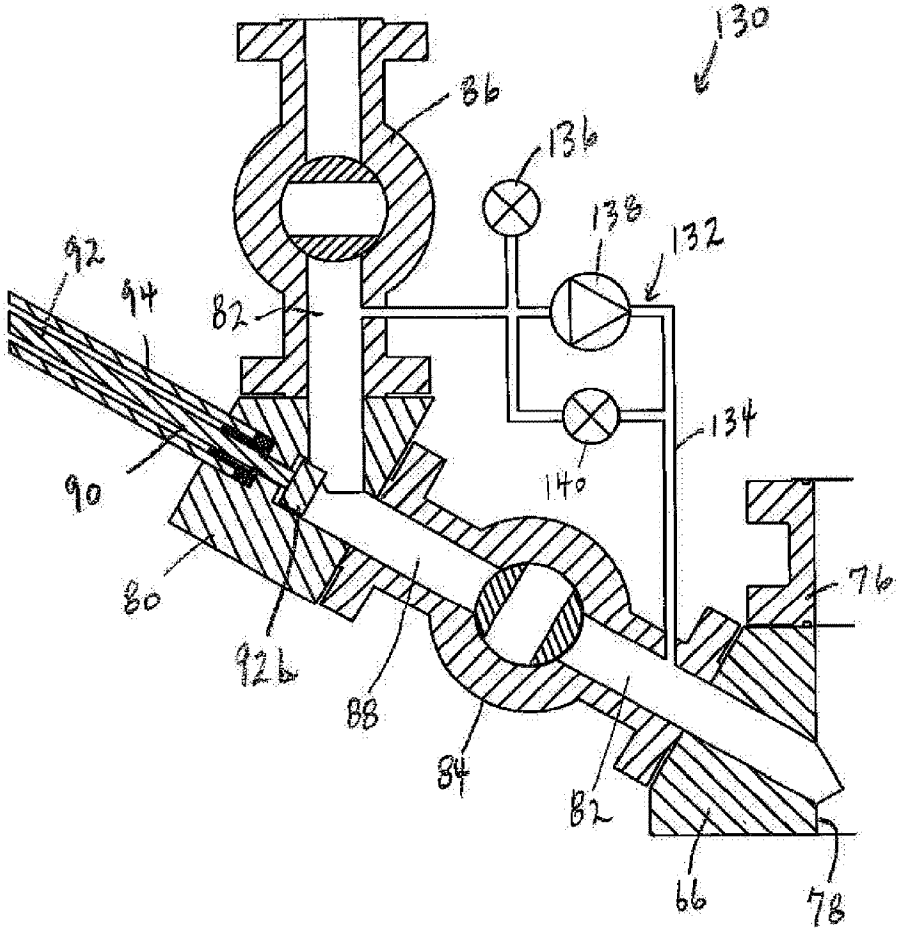

FIG. 15 is a section view of the ball injector of FIG. 3 or 13, adapted with a pump system to vent and/or equalize pressure across the first and second valve members for a ball drop operation to drop and move a ball from an atmospheric or low pressure setting to a higher pressure zone of the axial passage.

Figure 16:
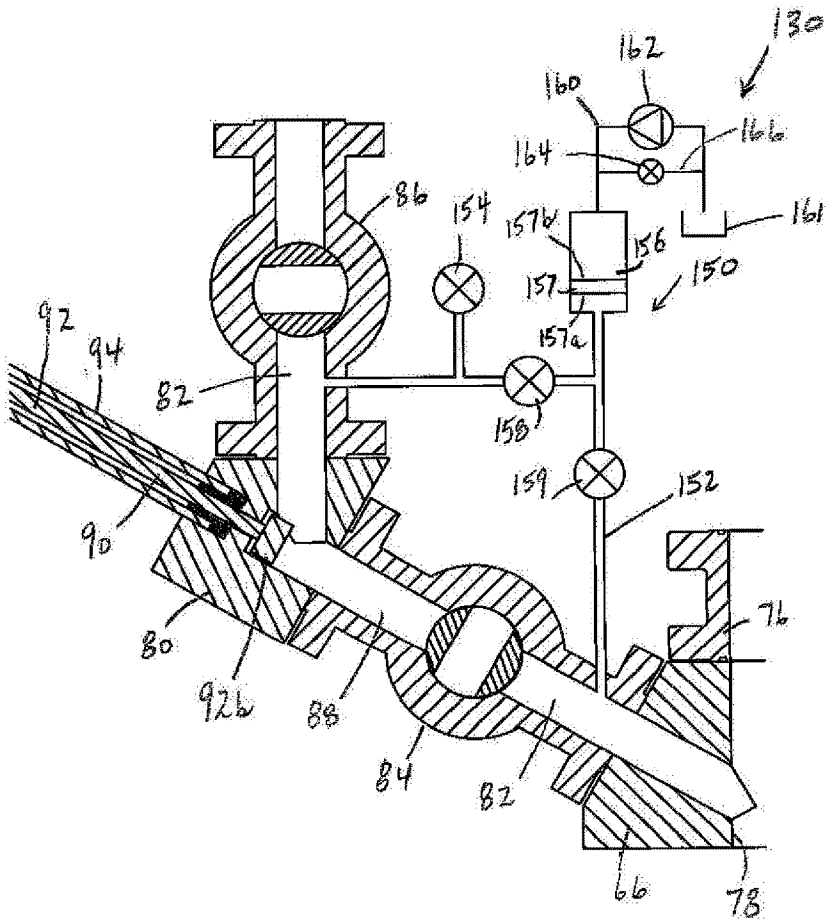

FIG. 16 is a section view of the ball injector of FIG. 3 or 13, adapted with a hydraulic accumulator system to vent and/or equalize pressure across the first and second valve members for a ball drop operation to drop and move a ball from an atmospheric or low pressure setting to a higher pressure zone of the axial passage.

Figure 17A:
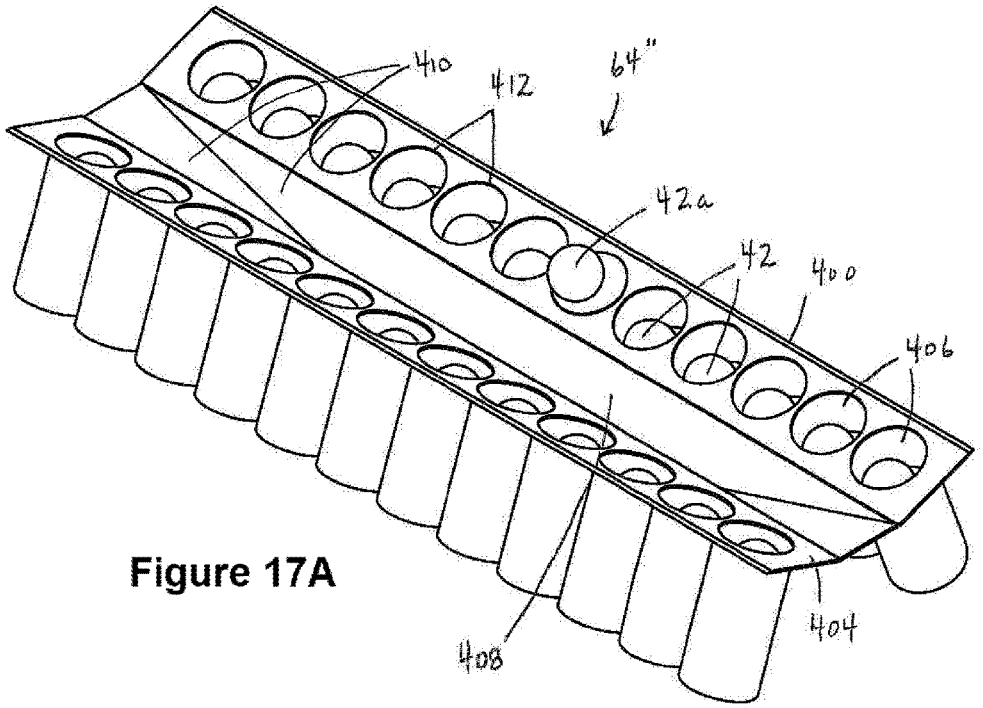

FIG. 17A is a top perspective view of a third embodiment of a ball cartridge assembly of FIG. 2, with the ball housing and top cover removed, showing a plurality of top opening ball cylinders arranged in parallel rows adjacent a central ball chute. Each ball cylinder includes piston which holds a ball generally horizontally below the top opening of the cylinder for launch over the top opening into the ball chute in order to sequentially deliver the ball to a ball launch position at the port.

Figure 17C:
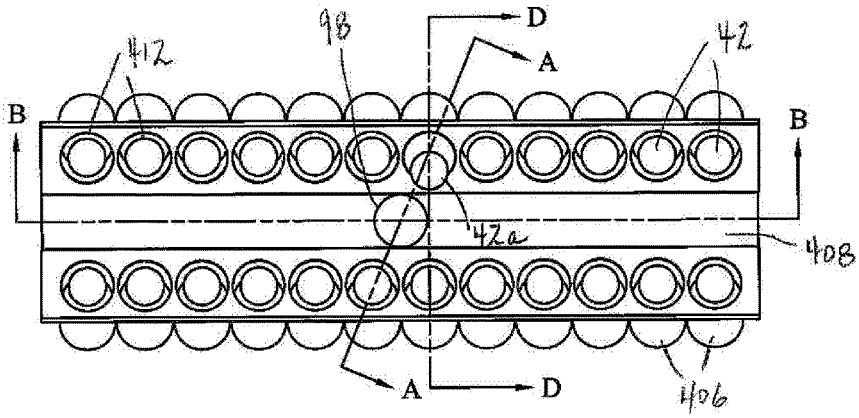
Figure 17B:
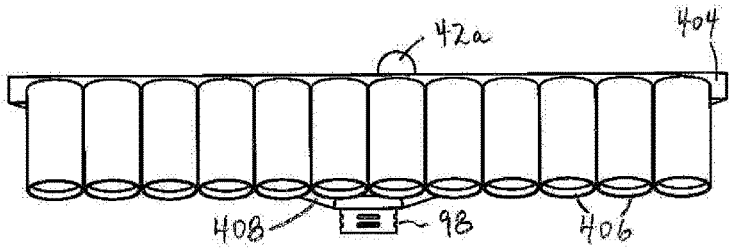

FIG. 17B is a bottom perspective view of the ball cartridge assembly of FIG. 17A.

FIG. 17C is a top view of the ball cartridge assembly of FIG. 17A.

Figure 17G:
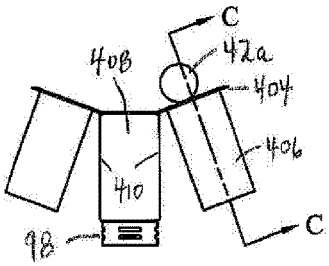
Figure 17D:
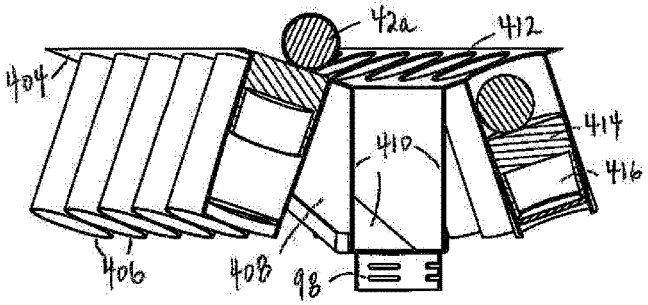

FIG. 17D is a perspective view of the ball cartridge assembly along line A-A of FIG. 17C.

Figure 17F:
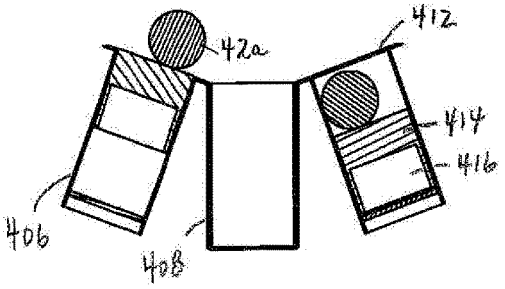
Figure 17E:
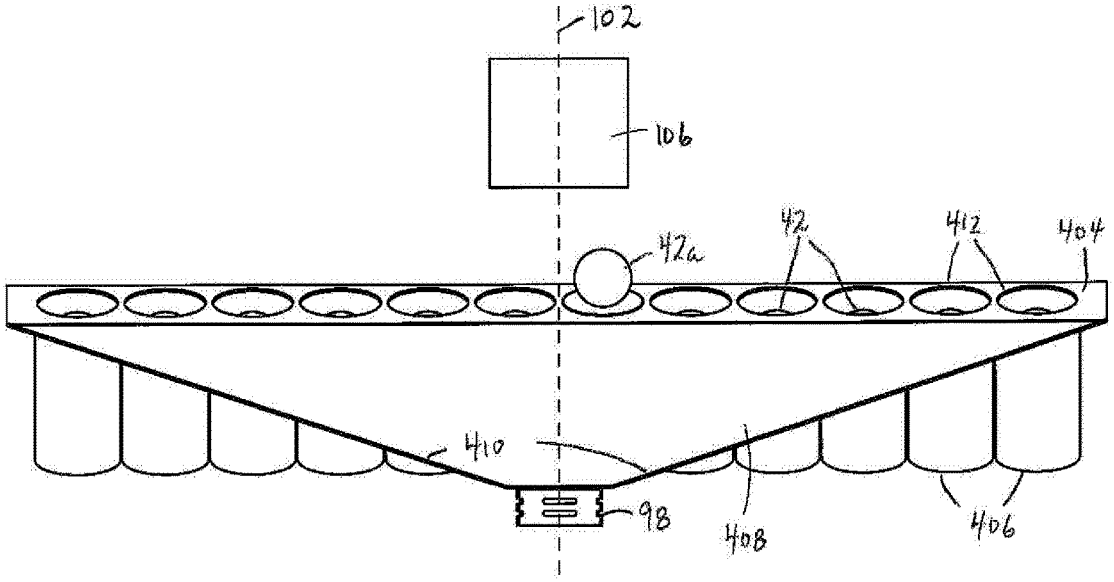

FIG. 17E is a perspective view of the ball cartridge assembly along line B-B of FIG. 17C.

FIG. 17F is a sectional view of the ball cartridge assembly taken along line D-D of FIG. 17C.

FIG. 17G is an end view of the ball cartridge assembly of FIG. 17A.

Figure 17H:
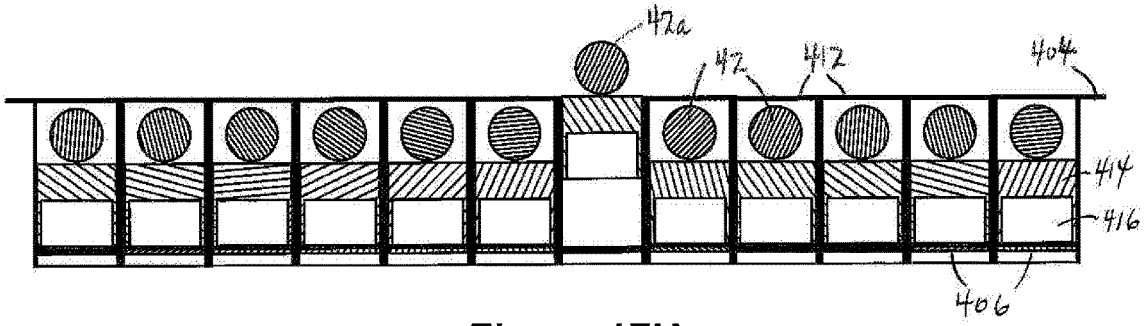

FIG. 17H is a section view of the ball cartridge assembly taken along line C-C of FIG. 17G.

DETAILED DESCRIPTION

Figure 1:
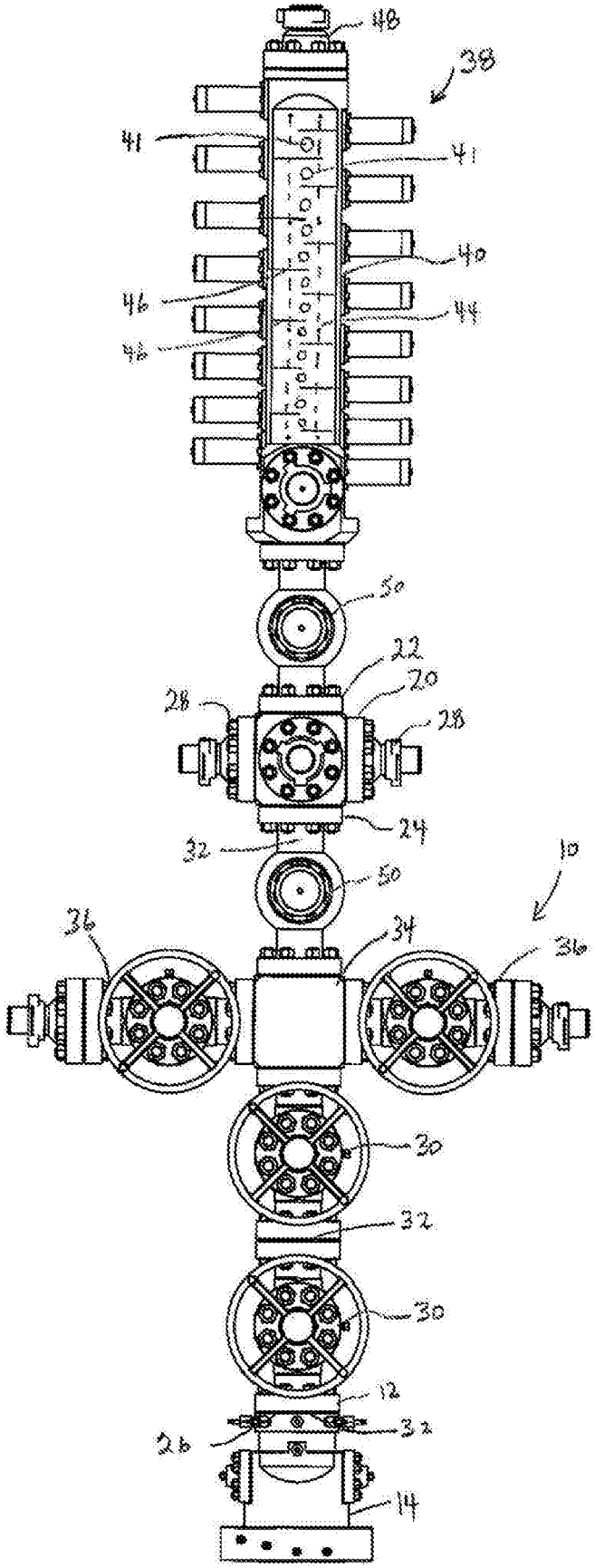
Figure 1 (PRIOR ART)

Exemplary embodiments of the ball injector and its components are shown in FIGS. 2-17, and are described in detail hereinbelow. To contrast, a prior art ball drop assembly is shown in FIG. 1 in association with industry standard frac tree components. The ball drop assembly of FIG. 1 is generally disclosed in U.S. Pat. Nos. 8,256,514 and 8,561,684 to Winzer mentioned above.

FIG. 1 shows an exemplary prior art fracturing tree ("frac tree") 10 having a bottom connector 12 for mounting to a wellhead 14. The frac tree 10 includes a frac head 20, sometimes referred to in the industry as a "pump block" or a "goat head", which is a large block of steel for injecting frac fluids into the frac tree under pressure. As used herein and in the claims, the term "frac head" is understood to comprise the block of a frac tree into which frac fluids are pumped under pressure. The frac head component 20 of the frac tree 10 is mounted above a wellhead 14, so may extend generally vertically upwardly to an elevation of about 14-16 feet (about 5 meters) from the generally horizontal ground. The frac head 20 has a top connector 22 and a bottom connector 24 and multiple fluid inlets 28. The connectors 22, 24 may be studded connectors, flange connectors or other known type wellhead connectors. The fluid inlets 28 are generally directed horizontally or upwardly from the frac head 20. Supply lines (not shown) are attached to the inlets 28. The inlets 28 allow the frac fluids to be combined from multiple supply lines into the central bore of the frac head 20. The combined flow of frac fluids is pumped downwardly under pressure through a bottom outlet 26 into the central bore of the wellhead 14. Generally, the frac tree 10 includes one or more master valves 30 below the frac head 20, and above the outlet 26. Two master valves are shown in FIG. 1. The master valves 30 are generally industry standard gate valves which may be manually controlled or remotely controlled such as hydraulically. A main axial passageway 32 extends through the frac tree 10 from the central bore of the frac head 20 through the master valves 30 to the outlet 26. The main axial passageway 32 is generally a radial passageway. FIG. 1 also shows a flow back tee 34, which is usually also a standard component of a frac tree. The flow back tee 34 accommodates fluids flowing back through the frac tree for diversion through the one or more valved side arms 36. The main axial passageway 32 of the frac tree 10 also extends through the flow back tee 34, if present. Other components, such as valves or adaptors may be present in a frac tree, as is well known in the industry.

FIG. 1 also illustrates an exemplary ball drop system 38, such as is described in U.S. Pat. Nos. 8,256,514 and 8,561,684 to Winzer. The system 38 includes a vertically stacked manifold 40 with a plurality of pre-loaded balls 41 oriented in a vertical stack in a long bore 44 axially aligned above the main axial passageway 32 of the frac tree 10. Each ball 41 is temporarily supported in the bore 44 by a rod 46. Each rod 46 is sequentially hydraulically actuated to withdraw from the bore 44 when required to release or launch the next largest ball. A pressure cap 48 is located at the top of the long bore 44, since the long bore 44 may be exposed to the pressure of the main axial passageway 32 as the ball is launched. Additional ball launch valves 50 are connected above and below the frac head 20 to stage the ball launch from the ball drop system 38 into the main axial passageway 32 of the frac tree 10. As is evident from FIG. 1, the vertical manifold 40 and the additional ball launch valves 50 add considerable extra vertical height above the frac tree 10, complicating safety, cost and installation concerns. As well, each ball 41 requires a separate device to be launched into the long bore 44, which can increase costs and may introduce reliability issues for successful ball launching.

Turning to FIG. 2, one exemplary embodiment of the ball injector of this application is shown generally at 60. The ball injector 60 is shown connected into a frac tree 10*a*. In FIG. 2, the frac tree 10*a* is illustrated with exemplary industry standard components which are labelled similarly to frac tree 10*a* of FIG. 1, although alternate or additional frac tree components may be included, as are well known in the industry. The ball injector 60 is shown to include a ball drive assembly 62 and a ball cartridge assembly 64, both of which are shown in schematic detail in FIG. 2. Exemplary embodiments of the ball cartridge assembly 64 are described in greater detail with reference to FIGS. 8-12 and 17A-17H. The ball cartridge assembly 64 typically includes a ball housing 65, which may be closed to the environment, and which provides access, such as with a removable or hinged top cover 65*a*. The ball cartridge assembly 64 stores one or more balls 42, typically a plurality of balls, for sequential delivery to a port 98 to be launched through the ball injector 60 into the axial passageway 32 of the frac tree 10*a*. In the Figures which follow, the ball 42*a* or the plurality of balls 42 are illustrated as radial balls, but as noted above, the invention is not limited to a particular type of shape of a ball to be used as an activation device for a downhole tool.

The ball injector 60 includes a pressure-containing injector housing 66, for example machined from one or more steel blocks. The injector housing 66 has a top end portion 68 which provides a top connector 70 for connection into the frac tree 10*a* at a position below the frac head 20, and a bottom end portion 72 which provides a bottom connector 74 for connection to a frac tree component below the injector housing 66. The top and bottom connectors 70, 74 may be a bolted flange connections as shown, or any other industry known connected such as studded connectors, threaded connectors, hub connectors, or welded connections. In the embodiment of FIG. 2, the housing 66 is shown to be connected above the flow back tee 34, and spaced from the frac head 20 and the flow back tee 34 by flanged adaptor spools 76. In some embodiments, one or more of the adaptor spools 76 may be omitted and the injector housing 66 itself may be connected to the frac tree components. Still alternatively, the injector housing may be formed integrally with one or more frac tree components. Still alternatively, other components such as valves or adapters may be included between the injector housing 66 and the frac head 20. In some embodiments, the injector housing 66 may be connected into the frac tree 10*a* at a lower position, for example between the master valves 30, or below the master valves 30 but above the bottom connector 12 of the frac tree 10*a*. While the bottom connector 12 is shown as a flange connection, other bottom connectors may include the bottom connector of the master valve, or separate bottom adaptor connectors. As noted above, flange connections are exemplary only, and other industry standard connectors, for example studded connectors, threaded connectors, hub connectors and welded connections, might be used.

Connecting into the frac tree 10*a* below the frac head 20 has the advantage of allowing the overall height of the frac tree with ball cartridge to be significantly reduced, particularly if the ball cartridge assembly supports the plurality of balls 42 horizontally. As well, additional ball launch valves such as are present in many of the prior art frac trees do not need to be added into the high turbulence areas of the frac tree 10*a*, simplifying the ball injector 60 and allowing for more reliable ball launch into the frac tree 10*a*. While in some embodiments, the ball injector 60 may be connected in other positions within the frac tree 10*a*, connecting into the frac tree 10*a* below the frac head and above the flow back tee 34, if present, has the advantage of reducing the erosion experienced by the ball injector housing 66 of the ball injector 60 during back flow operations.

As best seen in FIGS. 3-7, the injector housing 66 forms an axial passage 78 extending through the injector housing 66 from the top end portion 68 to the bottom end portion 72 in vertical axial alignment with the main axial passageway 32 of the frac tree 10*a*. The axial passage 78 is generally a radial passage to allow passage of balls 42.

The injector housing 66 includes a ball launch side arm 80 extending from the injector housing 66 and forming a ball launch passageway 82 communicating between the port 98 of the ball cartridge assembly 64 and the axial passage 78. The ball launch passageway 82 is generally a radial passageway to allow passage of the balls 42 from the ball cartridge assembly 64 into the axial passage 78. Multiple ball launch side arms 80 and ball cartridge assemblies may be included, however for simplicity, only one is shown in Figures.

The injector housing 66 includes at least one valve member 84 (a first valve member) in the ball launch passageway 82 to isolate the ball cartridge assembly 64 from the pressure in the axial passage 82 in a closed position, and to pass a ball 42 in an open position. In some embodiments which include a single valve member 84, the ball cartridge assembly 64 may be pressure-containing to withstand pressures from the axial passage 78, or the ball cartridge assembly may include a valve, for example at the port 98. Still alternatively, in some embodiments, one or more valves in the frac tree 10*a* located above and below the injector housing 66, and including the master valve 30, may be used during ball launch to allow the ball cartridge assembly 64 to remain at atmospheric pressure.

In some embodiments, and as shown in the Figures, a second valve member 86 is provided in the ball launch passageway 82 between the first valve member 84 and the ball cartridge assembly 64 so as to form a pressure isolation chamber 88 in the ball launch passageway 82 between the first and second valve members 84, 86. When both valve members 84, 86 are in the closed position (FIG. 3), the pressure isolation chamber 88 and the ball cartridge assembly 64 are isolated from pressure in the axial passage 82, and thus the ball cartridge assembly 64 may be maintained at atmospheric pressure, or a pressure below the pressure of the axial passage 78. When the second valve member 86 is in an open position and the first valve member 84 is in a closed position (FIG. 4), the ball 42 may be delivered from the ball cartridge assembly 64 into the pressure isolation chamber 88 (FIG. 5). When the second valve member 86 is thereafter moved to a closed position and the first valve member 84 is moved to an open position (FIG. 6), the ball 42 may be driven by the ball drive assembly 62 through the pressure isolation chamber 88 and through the first valve member 84 into the axial passage 78 (FIG. 7), while the ball cartridge assembly 64 remains isolated from the pressure of the axial passage 78. The first valve member 84 may then be moved to the closed position to isolate the ball cartridge assembly 64 and the portion of the ball launch passageway 82 between the first valve member 84 and the ball cartridge assembly 64 is again isolated from pressure in the axial passage 78. This sequence is shown generally schematically with one ball 42*a* of the plurality of balls 42 in FIGS. 3-7, and can be repeated for each subsequent ball sequentially launched from the ball cartridge assembly 64.

The valve members 84, 86 may be provided as same or different valve members, for example as plug valves, ball valves, gate valves or check valves, to provide a passage extending through each of the valve members 84, 86 to allow the ball 42 to pass through the valve. For spherical balls, a radial passageway may be provided through the ball launch passage 82 and through the valve members 84, 86. For the high pressure applications such as fracing, the valve members 84, 86 and connections from the port 98 to the axial passage 78, provide seals and pressure ratings to withstand the expected elevated pressures of the axial passage 78.

FIG. 2 shows one embodiment of a pressure adjustment system, such as a bleed off valve 89, leading into the pressure isolation chamber 88 to vent air and/or fluid, and to release pressure from the pressure isolation chamber 88 between or during cycles of opening and closing of the first and second valve members 84, 86. The pressure adjustment system may also be used to adjust or equalize pressure across the valve members during the ball launch and injection sequence.

An embodiment of a ball drive assembly 62 is shown in FIGS. 2-7 to include a driven push rod 90 mounted and sealed to the ball launch side arm 80 to provide, reciprocating movement through the pressure isolation chamber 88, through the open position of the first valve member 84, up to the axial passage 78. In the fully extended position (FIG. 7), the push rod 90 drives the ball 42 to the axial passage 78, without extending into the axial passage 78. In the fully retracted, stowed position (FIGS. 3-6), the push rod 90 allows a ball 42 to be delivered from the ball cartridge assembly 64 into the pressure isolation chamber 88, clear of the push rod 90. The push rod 90 may be driven manually, electrically, hydraulically or pneumatically. For example, the push rod 90 may be the piston 92 of a hydraulic cylinder 94, and a hydraulic drive system 96 may be operated remotely from the frac tree 10*a*. In some embodiments, the push rod 90 may mounted in a threaded arrangement into the pressure isolation chamber and may be operated manually, or remotely operated, for example with an electric motor.

As shown in FIGS. 2-7, the push rod 90 may be the portion of the hydraulic piston 92 extending from the hydraulic cylinder 94 through a seal gland 95, into the pressure isolation chamber 88. This pushing end portion of the hydraulic piston 92 (i.e., the portion which extends into the pressure isolation chamber 88 in the fully extended position) might be integral with the portion of the piston which remains in the hydraulic cylinder 94 in the fully extended position, or the two portions may be interconnected. The seal gland 95 seals hydraulic fluid within the cylinder 94, while also withstanding pressure from the axial passage 78 to prevent fluids moving through the axial passage 78 from entering the cylinder 94. A pushing end portion 92*a* of the piston 92 located within the pressure isolation chamber 88 includes a block 92*b* which contacts the ball 42 and moves the ball 42 through the pressure isolation chamber 88 and through the first valve member 84 as the piston 92 is extended. The block 92*b* may be integral with the piston end portion 92*a*, or connected thereto. The block 92*b* also functions to centralize the piston 92 within the pressure isolation chamber 88 and the first valve member 84, and to prevent smaller balls or debris from being trapped between the piston 92 and the walls of the pressure isolation chamber 88. In alternate embodiments, the block 92*b* may not be needed if the piston is enlarged, however, a larger piston requires additional energy to be driven. Seals are not needed on the piston block 92*b* or push rod portions moving within the pressure isolation chamber 88, since the first and second valve members 84, 86 isolate pressure in the pressure isolation chamber 88, and the hydraulic cylinder 94 is sealed to the side arm 80 with seal gland 95. The piston block 92*b* may be generally cylindrically-shaped with some clearance between its outer circumference and the walls of the pressure isolation chamber 88 and the first valve member 84 to allow for reciprocating movement therethrough.

As shown in FIG. 7, in the fully extended position of the piston 92, the piston end portion 92*a* and the block 92*b* do not extend into the axial passage 78, but end within the ball launch passageway 82 at the intersection with the axial passage 88. A stop 97 on the rod of the piston 92, located within the cylinder 94, limits piston travel for this purpose, but other stop mechanisms might be used, such as a stop on the cylinder itself. In this arrangement, the axial passage 78 of the ball injector 60, as well as the main axial passageway 32 of the frac tree 10*a*, remain unblocked and unobstructed during the entire ball launch and injection sequence, so as not to limit flow in the axial passage 78 or the axial passageway 32.

In some embodiments the portion of the ball launch passageway 82 (a first portion) extending through the pressure isolation chamber and through the open position of the first valve member 84 to the axial passage 78 is axially aligned along a first axis 100, while the portion of the ball launch passageway 82 (a second portion) extending through the pressure isolation chamber 88 and through the open position of the second valve member 86 to a port 98 in the ball cartridge assembly 64 is axially aligned along a second axis 102, with the two axes 100, 102 intersecting in the pressure isolation chamber 88. In these embodiments, the pressure isolation chamber 88 between the first and second valve members 84, 86 is divided into two legs, a first leg 88*a* extending along the first axis 100 and a second leg 88*b* extending along the second axis 102. In these embodiments, the push rod 90 is driven forwardly along the first axis 100, from the fully retracted, stowed position, clear of the second leg 88*b*, as shown in the sequence of FIGS. 3-7. In the fully retracted, stowed position of the push rod 90, as shown in FIG. 3, the push rod 90, and the block 92*b* if present, are retracted to be clear of the second leg 88*b* of the pressure isolation chamber 88, and clear of the intersection of the two axes 100, 102, so as not to interfere with the ball 42 being delivered through the second leg 88*b* along the second axis 102. The second axis 102 may be generally vertical, as shown in FIGS. 3-7, so that gravity assists the ball 42 in being delivered through the second valve member 86 into the pressure isolation chamber 88. The angle between the two axis 100, 102, shown as angle A in FIG. 3, may be an obtuse angle, for example between about 100 to 140 degrees. The first axis 100 may intersect the general vertical axis of the axial passage 78 at 90 degrees or less, for example at an acute angle B, such as between about 40 to 80 degrees. With the first axis 100 meeting the axial passage 78 at an acute angle, as shown in FIGS. 3-7, gravity assists the ball being driven along the first axis 100.

In some embodiments of operating the ball injector 60, a step may be inserted between FIGS. 5 and 6, as shown in FIG. 7A. After the ball 42*a* is delivered from the ball cartridge assembly 64 into the pressure isolation chamber 88, as shown in FIG. 5, the second valve member 86 is left in an open position while the push rod 90 and block 92*b* are moved from the fully retracted, stowed position to a blocking position, as shown in FIG. 7A, in which the ball 42*a* is moved incrementally forwardly (i.e., toward the axial passage 78) with the block 92*b* preventing the ball 42*a* from moving backwardly in leg 88*b*, toward the second valve member 86. More particularly, with the first valve member 84 still in the closed position, the ball 42*a* is moved incrementally forwardly along the first leg 88*a* of the pressure isolation chamber 88, until the ball 42*a* is clear of the second leg 88*b* of the pressure isolation chamber 88, and the block 92*b* of the push rod 90 blocks the second leg 88*b* to prevent or block the ball 42 from moving backwardly (or vertically) within the second leg 88*b* of the pressure isolation chamber 88 toward the second valve member 84. This step avoids causing damage to the ball 42*a* with the push rod 90, and ensures the ball 42*a* is trapped within the first leg 88*a* before the first valve member 84 is opened.

The particular arrangement of the first and second valve members 84, 86, as described above, and as shown in FIG. 7A, but with the second valve member 86 open and the first valve member 84 closed, allows for a monitoring view of the ball progression downwardly from the port 98 of the ball cartridge assembly 64, through the open position of the second valve member 86, along the second leg 88*b* to ensure:

a) the ball 42*a* has moved forwardly, beyond the intersection of the first and second axes 100, 102, and b) the push rod 90 and the block 92*a* are moved in the blocking position to trap the ball 42*a* within the leg 88*a*.

Monitoring can be achieved remotely, by mounting a sensor, such as a camera, at and/or above the port 98 of the ball cartridge assembly, as described more fully below. Providing this view, particularly by remote sensing, is extremely helpful to the frac operator. Once this ball progression of steps a) and b) are confirmed, the second valve member 86 is then closed, the first valve member 84 is moved to the open position, and the ball 42*a* is blocked from backward movement within the pressure isolation chamber 88. The operator can be confident that further forward driven movement of the push rod 90 by the ball drive assembly 62 moves the ball 42*a* through the first leg 88*a* of pressure isolation chamber 88 and through the first valve member 84 into the axial passage 78, as described above for FIGS. 6 and 7.

In some embodiments, the incremental movement of the push rod 90 and block 92*b* from the fully retracted, stowed position to the blocking position can be made with the ball drive assembly 62, such as with the hydraulic cylinder 94. In some embodiments, a separate or additional drive mechanism for this incremental movement may be provided. FIGS. 13 and 14 show a spring assembly 120 mounted at the remote end of the hydraulic cylinder 94. The assembly 120 includes a cylindrical housing 122 connected to the end of the hydraulic cylinder 94. A compression spring 124 within the housing 122 is biassed against a positioner rod 126, which extends into the hydraulic cylinder 94 in a sealed arrangement, to push against the stop 97 at the end of the piston 92. The spring 124 works with the hydraulic drive system 96, but provides the spring bias to move the push rod 90 and the block 92*b* incrementally from the fully retracted, stowed position to the blocking position, as shown above in FIGS. 5 and 7A respectively. Windows 128 in the housing 122 provide a visual indication of the position and progression of the positioner rod 126 through this incremental movement. This visual indication ensures the progression of steps a) and b) above have occurred before the second valve member 86 is closed and the first valve member 84 is opened. Furthermore, after opening the first valve member, the visual indication of the positioner rod 126 confirms that the positioner rod 126 has not moved backwardly, ensuring that the block 92*b* remains in the blocking position of FIG. 7A. Further driven movement of the push rod 90 with the piston 92 along leg 88*a* and through the first valve member 84 is provided by the hydraulic drive system 96.

As shown in FIG. 14, in some embodiments, windows 129 at the opposite end of the hydraulic cylinder 94, proximate the connection to the ball launch side arm 80, provide additional visual indication of the piston 92 progression up to the fully extended position of the push rod 90, to ensure that the push rod 90 and block 92*b* are at the intersection of the axial passage 78, and thus to confirm that the ball 42*a* is delivered to the axial passage 78. Gradations or colour markings may be used on portions of the piston 92 and/or positioner rod 126 to assist in the visual monitoring of the progression of the push rod 90 and block 92*a* for the operator. Still further, the positions may be remotely monitored with additional sensors or camera instrumentation.

It will be appreciated that the spring assembly 120 reduces the length of the piston 92 (and push rod 90), and thus reduces the length and weight of this portion of the ball injector 60.

In some embodiments the ball injector 60 provides for pressure adjustment for the pressure isolation chamber 88, to adjust or equalize the pressure across one or both of the first and second valve members 84, 86 during the ball launch and injection sequence. Pressure adjustment may include a bleed off valve 89 extending into the pressure isolation chamber 88, as shown in FIG. 2, to vent, release or add a gas or fluid to the chamber 88. In some embodiments, the pump system used for the fracing operation may be used to adjust or equalize the pressure in the pressure isolation chamber 88 and across the valve member 84, 86. In some embodiments, the ball injector may include a pressure adjustment system 130, such as shown in FIGS. 15 and 16, to adjust or equalize pressure in the pressure isolation chamber 88 by adjusting or equalizing the pressure across the valve members 84, 86. Pressure adjustment minimizes shock loading in leg 88*a* of the pressure isolation chamber 88, and thus on a ball located in leg 88*a*, on opening the first valve member 84. In some embodiments a pressure adjustment system can be used as a ball drive system to drive and deliver the ball along leg 88*a* to the axial passage 78.

FIG. 15 shows an exemplary pump system 132 for a pressure adjustment system 130. The pump system 132 provides a line 134 extending from the pressure isolation chamber 88 to a pressurized portion of the ball launch passageway 82, such as between the first valve member 84 and the axial passage 78. The line 134 includes an air bleed valve 136, pump 138 and equalization valve 140. For opening the second ball member 86, and dropping the ball through the second leg 88*b*, the pump 138 is used to pump fluid from the pressure isolation chamber 88 to equalize pressure across the second valve member 86, while the air bleed valve 136 vents off any residual pressure. Once the ball is dropped, the second valve member 86 is closed, and the equalization valve 140 is opened to allow the fluid from the axial passage 78 to pressurize the pressure isolation chamber 88 and to equalize the pressure across the first valve member 84. Once this pressure is equalized, the equalization valve 140 is closed and the first valve member 84 is opened to allow the ball to be delivered from the pressure isolation chamber 88, through the first valve member 84, to the axial passage 78. After withdrawing the push rod 90, the first valve member is then closed, and the pressure adjustment cycle is repeated for the next ball launch and delivery sequence.

FIG. 16 shows an exemplary accumulator system 150 as a pressure adjustment system 130. The accumulator system 150 is shown as an hydraulic accumulator, but a pneumatic system may be used. The accumulator system 150 includes a line 152 extending from the pressure isolation chamber 88 to the pressurized portion of the ball launch passageway 82, such as between the first valve member 84 and the axial passage 78. An air bleed valve 154 and a hydraulic accumulator 156 are provided in the line 152. The hydraulic accumulator 156 includes a piston 157, having a fluid side 157*a* and a hydraulic fluid supply side 157*b*. Inlet and outlet valves 158, 159 to the accumulator 156 are provided in the line 152. The hydraulic accumulator 156 is supplied with hydraulic fluid through supply line 160 from a tank 161 with an hydraulic pump 162. An hydraulic bleed valve 164 is included in bypass line 166 between the tank 161 the accumulator 156. The accumulator 156 is held full of hydraulic fluid until pressure adjustment is initiated. To equalize pressure across the second valve member 86 (before opening valve member 86), the inlet valve 158 and the hydraulic bleed valve 164 are opened to allow any fluid in the pressure isolation chamber 88 to move through line 152 to the fluid side 157*a* of the accumulator 156, displacing the piston 157 moving hydraulic fluid to the tank 161. The air bleed valve 154 vents off any residual air pressure. The second valve member 86 is then opened, and the ball is dropped through the valve ember 86. Once the second valve member 86 is closed, the outlet valve 159 is opened to allow fluid from the axial passage 78 to pressurize the pressure isolation chamber 88 and to equalize the pressure across the first valve member 84. Hydraulic fluid is then pumped with pump 162 into the accumulator 156 to displace fluid from the accumulator 156 and line 152 into the axial passage 78. The inlet and outlet valves 158, 159 are closed and the first valve member 84 is opened to deliver the ball through the first valve member 84 to the axial passage 78.

Other pressure adjustment systems as are well known in the industry may be used in place of the systems shown in FIGS. 2, 15 and 16.

One exemplary embodiment of the ball cartridge assembly 64 is shown in FIGS. 8-9 as a rotary carousel ball cartridge assembly 200. A ball housing 202 includes a horizontal, stationary ball support structure 204 formed with a port 98 which is axially aligned with the second axis 102 of the ball launch passageway 82. A carousel 206 is mounted for rotation on the ball support structure 204 as it is driven by a drive mechanism such as an electric motor 208. The carousel 206 forms a plurality of open bottom ball cavities 209, each sized to hold one of the plurality of balls 42. The ball housing 202 may include side walls 210 and a removable top cover 212 which can be fastened by bolts 214 over the carousel 206 to keep debris from the balls once they are loaded in the desired sequence for delivery to the port 98. The top cover 212 is removed in FIG. 8. A square aperture 216 in the carousel may be provided for connection to the drive shaft of the motor 208 to rotate the carousel 206 on its central vertical axis. In FIG. 9, one of the balls 42*a* is positioned at the port 98 in the ball launch position to be delivered along the second axis 102 into the ball launch passageway 82.

A second embodiment of the ball cartridge assembly 64' is shown in FIGS. 10-12 as a driven chain ball cartridge assembly 300. A ball housing 302 includes a horizontal, stationary ball support structure 304 formed with a port 98 which is axially aligned with the second axis 102 of the ball launch passageway 82. An endless driven chain 306 is wrapped around a plurality of free rotating sprockets 308, each of which is rotatably connected to the ball support structure 304. A drive gear 310 is connected to the chain 306. A square aperture 312 in the gear 310 provides a connection to the drive shaft of a drive mechanism such as an electric motor 314. An endless slot 316 is formed in the ball support structure 304 along the path of the driven chain 306. A plurality of spaced apart paddles 318 are connected to the drive chain 306 and extend upwardly through the slot 316 into the ball housing 302 above the ball support structure 304. Inner and outer walls 320, 322 above the ball support structure 304 form a curved raceway 324 following the path of the slot 316 and chain 306, and which confine each one of the plurality of balls 42 between two adjacent of the spaced apart paddles 318. When the chain 306 and paddles 318 are driven by the motor 314, the plurality of balls 42 are sequentially delivered to a ball launch position at the port 98 to be delivered along the second axis 102 into the ball launch passageway 82. To assist at the ball launch position, a vertical guide wall 326 is positioned at an angle adjacent the port 98 to direct the ball 42 from the raceway 324 to the port 98. A removable top cover 328 is bolted in place above the raceway 324 to keep debris from the balls 42 once they are loaded in the desired sequence for delivery to the port 98. A bottom plate 330, visible in FIG. 11, but removed in FIG. 12, closes the bottom of the ball housing 302.

A third embodiment of the ball cartridge assembly 64" is shown in FIGS. 17A-17H as a piston actuated ball cartridge assembly 400. The assembly 400 is generally housed in a ball housing 65 with a top cover 65*a*, with bottom port 98 communicating with the ball launch passageway 82 of the ball injector 60, as described above for FIG. 2. The port 98 is axially aligned with the second axis 102 of the ball injector 60. FIGS. 17A-17H show a ball support structure 404 including two parallel rows of top opening ball cylinders 406 arranged adjacent a ball chute 408 located centrally between the rows of ball cylinders 406. When the ball 42 is a radial ball, the ball chute 408 includes angled side walls 410 which taper from the support structure at the top openings of the cylinders 406 to the port 98 to gravity feed the ball 42 to the port 98. Each ball cylinder 406 has a top opening 412 located adjacent the ball chute 408, and which may be angled toward the ball chute 408 to ensure that the ball 42 is gravity fed from the top opening 412 into the ball chute 408. Each ball cylinder 406 includes a piston 414 which holds the ball 42 generally horizontally below the top opening 412 when in the stowed position. Each piston 414 is individually actuated, for example hydraulically, electrically, pneumatically, or mechanically to launch the ball 42 generally upwardly over the top opening 412 into the ball chute 408. In this manner, each of the balls 42 may be sequentially delivered to a ball launch position at the port 98. For a pneumatically actuated piston system, an inflatable air bag 416 may be provided in each ball cylinder 406, as shown in FIG. 17.

As described hereinabove, the one of more balls 42 may be delivered from the ball cartridge assembly 64 into the ball launch passageway 82 by gravity. It will be appreciated that other embodiments of a ball cartridge assembly as are known in the art may be used to store and deliver the one or more balls to the ball launch passageway 82. For example, the ball dropper device of U.S. Pat. Nos. 8,256,514 and 8,561,684 may be adapted for connection to the ball launch passageway 82. If the ball dropper device itself is pressurized, the second valve member 86 may be omitted from the ball injector 60.

In other embodiments, the ball cartridge assembly 64, or an alternate ball dropper device such as shown in U.S. Pat. Nos. 8,256,514 and 8,561,684, may be connected to one or more fluid conduits to provide a fluid flow through the ball cartridge assembly and into the ball launch passageway 82. The fluid flow acts as the driving force for launching of the ball 42. An exemplary fluid conduit system for this purpose is illustrated in U.S. Pat. Nos. 8,256,514 and 8,561,684, the details of which are specifically incorporated by reference herein. As mentioned above, a pressure adjustment system may be used as a ball drive system, for example by providing a port into leg 88*a* of the pressure isolation system behind the dropped ball, to drive the ball to the axial passage 78.

Still alternatively, a fluid conduit may be serve as an extension of the ball launch passageway 82, and a ball cartridge assembly may be located remotely from the frac tree 10 for delivering the one or more balls to the ball launch passageway. In such embodiments, the ball launch passageway includes one or more fluid conduits extending from a port in the remote ball cartridge assembly to the components of the ball injector located at the frac tree 10*a*.

In embodiments for which a fluid driving force is used to deliver the one or more balls to the ball launch passageway 82, such as those described above, the ball drive assembly 62 is understood to refer to a fluid drive system, including fluid pumps and fluid conduits, as are known in the art. The push rod as described above, may not be needed for embodiments which include a fluid drive.

In the embodiments of the ball cartridge assembly 64, 64' and 64", a sensor is mounted vertically above or at the port 98 in the ball cartridge assembly 64 to provide a signal indicative of a successful ball launch of a ball through the port 98 into the ball launch passageway 82, and up to the blocking position of the push rod 90 and block 92*b*, as mentioned above. In the Figures, the sensor is depicted as a camera 106 to generate a visual image of the ball 42 through the port 98. This arrangement allows for remote monitoring of a successful ball launch into the ball launch passageway 82. The features of aligning the port 98 with the second axis 102 of the ball injector 60, and arranging the balls generally horizontally for sequential delivery to the port 98, allows for an unobstructed view downwardly through the port 98, through the second valve member 86 into the pressure isolation chamber 88 to the intersection of the first and second axes 100, 102. In this manner, during the steps of delivering the ball, the position of the ball 42*a* and the block 92*a* of the push rod 90 can be remotely monitored, for example with a camera or other sensor mounted above or at the port 98, to ensure that the ball 42*a* and the block 92*a* have moved incrementally beyond the intersection of the first and second axes 100, 102 to the blocking position before the second valve member 86 is moved to the closed position and the first valve member 84 is moved to the open position. In some embodiments, when the ball cartridge assembly 64 is maintained at atmospheric pressure, or well below the pressure of the axial passage 78, the camera 106, or other positional sensors, can be operated at atmospheric conditions and outside the pressures and fluid conditions of the fracing operation. This addresses a major problem in the heretofore fracing operations, which lack confirmation of the ball position within the ball injection equipment and into the axial passage 78 below the frac head 20.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practised in the absence of any element or elements, limitation or limitations which is not specifically disclosed herein.

We claim:

1. A ball injector for connecting to a pressure-containing frac tree and accommodating a ball from one or more balls to be sequentially dropped by the ball injector through a main axial passageway of the frac tree, the frac tree being of the type having a frac head into which frac fluids are pumped under pressure, one or more master valves below the frac head, optionally a flow back tee between the frac head and the one or more master valves, and a wellhead connector at the bottom of the frac tree to connect to a wellhead, the main axial passageway extending generally vertically through the frac head, the one or more master valves and the optional flow back tee, the ball injector comprising:

a pressure-containing injector housing having a top end portion and a bottom end portion and an axial passage extending from the top end portion to the bottom end portion, the top end portion and the bottom end portion being adapted to connect the injector housing into the frac tree below the frac head and above the wellhead connector such that the axial passage is aligned with the main axial passageway of the frac tree;

a ball cartridge assembly adapted to store the one or more balls and to sequentially deliver one of the balls to a port in the ball cartridge assembly;

a ball launch side arm extending from the injector housing and forming a ball launch passageway communicating between the port of the ball cartridge assembly and the axial passage for passage of the ball from the ball cartridge assembly to the axial passage; and a first valve member in the ball launch passageway, the first valve member being adapted to pass the ball into the axial passage in an open position and to isolate the ball cartridge assembly and the ball launch passageway from pressure in the axial passage in a closed position.

2. The ball injector of claim 1, further comprising;

a ball drive assembly in sealed relationship with the ball launch passageway to drive the ball through the ball launch passageway and through the first valve member into the axial passage.

3. The ball injector of claim 2, wherein:

the ball launch passageway is a radial passageway;

a first portion of the ball launch passageway extending through the open position of the first valve member to the axial passage is axially aligned along a first axis;

a second portion of the ball launch passageway extending from the port of the ball cartridge assembly is axially aligned along a second axis which intersects the first axis; and a pressure adjustment system connected to the ball launch passageway is included to adjust pressure across the first valve member.

4. The ball injector of claim 2, further comprising:

a second valve member in the ball launch passageway between the first valve member and the ball cartridge assembly so as to form a pressure isolation chamber in the ball launch passageway between the first valve member and the second valve member, such that, when the first valve member and the second valve members are both in a closed position, the ball cartridge assembly and the pressure isolation chamber are isolated from the pressure in the axial passage, when the second valve member is in an open position and the first valve member is in the closed position, the ball may be delivered from the ball cartridge assembly through the second valve member into the pressure isolation chamber, and when the second valve member is in the closed position and the first valve member is in the open position the ball may be driven by the ball drive assembly through the pressure isolation chamber and through the first valve member into the axial passage while the ball cartridge assembly remains isolated from the pressure of the axial passage.

5. The ball injector of claim 4, further comprising a bleed off valve connected to the pressure isolation chamber to release one or both of air or fluid from the pressure isolation chamber.

6. The ball injector of claim 4, further comprising a pressure adjustment system connected to the pressure isolation chamber to adjust pressure across one or both of the first valve member and the second valve member.

7. The ball injector of claim 6, wherein the pressure adjustment system is adapted to adjust pressure across each of the first and second valve members, and further includes a bleed off valve to release one or both of air or fluid from the pressure isolation chamber.

8. The ball injector of claim 7, wherein the pressure adjustment system includes a pump system or a hydraulic accumulator system connected between the pressure isolation chamber and to the ball launch passageway between the first valve member and the axial passage.

9. The ball injector of claim 6, wherein the ball drive assembly includes a push rod extending into the ball launch passageway for driven, reciprocating movement through the pressure isolation chamber and through first valve member to drive the ball through the pressure isolation chamber and the first valve member to the axial passage.

10. The ball injector of claim 9, wherein:

the ball launch passageway is a radial passageway;

a first portion of the ball launch passageway extending through the pressure isolation chamber and through the open position of the first valve member to the axial passage is axially aligned along a first axis;

a second portion of the ball launch passageway extending through the pressure isolation chamber and through the open position of the second valve member to the port of the ball cartridge assembly is axially aligned along a second axis which intersects the first axis within the pressure isolation chamber; and the push rod is driven along the first axis.

11. The ball injector of claim 10, wherein the ball drive assembly drives the push rod manually, electrically, hydraulically or pneumatically.

12. The ball injector of claim 10, wherein the second axis is generally vertical such that gravity assists the ball being delivered through the second valve member into the pressure isolation chamber.

13. The ball injector of claim 12, wherein the first axis intersects the axial passage at an angle of 90 degrees or less.

14. The ball injector of claim 13, wherein:

the push rod is a piston of a cylinder;

a pushing end portion of the piston moves through the pressure isolation chamber and the first valve member and includes a block to contact and push the ball;

one or both of the piston and the cylinder is adapted to limit travel of the push rod and the block so that the block does not extend into the axial passage in a fully extended position of the push rod.

15. The ball injector of claim 14, wherein the block of the push rod is adapted to be clear of the second axis in a fully retracted, stowed position of the push rod so that the ball is delivered into the pressure isolation chamber forwardly of the block, along the second axis to the intersection of the first and second axes, and wherein the block is adapted to prevent the ball from moving backwardly along the second axis once the block is driven forwardly to a blocking position, beyond the intersection of the first and second axes, toward the axial passage.

16. The ball injector of claim 15, wherein the ball drive assembly includes a spring assembly to incrementally move the push rod and the block of the push rod from the fully retracted, stowed position to the blocking position.

17. The ball injector of claim 16, wherein the ball drive assembly includes one or more position indicators to indicate one or more of the fully retracted position, the blocking position, and the fully extended position of the push rod and the block.

18. The ball injector of claim 14, wherein the first axis intersects the axial passage at an acute angle such that gravity assists the ball being driven along the first axis.

19. The ball injector of claim 18, wherein the first axis intersects the second axis at an obtuse angle.

20. The ball injector of claim 1, wherein the ball cartridge assembly is adapted to hold a plurality of balls arranged generally horizontally for sequential delivery through a port in the ball cartridge assembly into the ball launch passageway.

21. The ball injector of claim 1, wherein the injector housing is adapted to be connected into the frac tree above the flow back tee.

22. The ball injector of claim 10, wherein the ball cartridge assembly comprises:

a ball housing having a ball support structure adapted to hold a plurality of balls generally horizontally relative to the second axis, the ball support structure including a plurality of spaced apart paddles such that each one of the plurality of balls may be confined between two adjacent of the spaced apart paddles;

the ball support structure providing the port of the ball cartridge assembly to communicate with the ball launch passageway, and which is axially aligned with the second axis; and a driven chain connected to each of the plurality of spaced apart paddles to move the plurality of balls sequentially into a ball launch position at the port.

23. The ball injector of claim 10, wherein the ball cartridge assembly comprises:

a ball housing having a ball support structure adapted to hold a plurality of balls generally horizontally relative to the second axis;

the ball support structure providing the port of the ball cartridge assembly to communicate with the ball launch passageway, and which is axially aligned with the second axis: and a carousel mounted for rotation on the ball support structure, the carousel being adapted to hold the plurality of balls such that each of the plurality of balls may be confined in a ball cavity of the carousel for sequential delivery to a ball launch position at the port upon rotation of the carousel.

24. The ball injector of claim 10, wherein the ball cartridge assembly comprises:

a ball housing having a ball support structure adapted to hold a plurality of balls generally horizontally relative to the second axis;

the ball support structure providing the port of the ball cartridge assembly to communicate with the ball launch passageway, and which is axially aligned with the second axis;

the ball support structure including a plurality of top opening ball cylinders arranged in one or more rows adjacent a ball chute, each of the plurality of ball cylinders including a piston adapted to hold one of the plurality of balls generally horizontally below the top opening of the ball cylinder, and to launch the ball over the top opening of the ball cylinder into the ball chute for sequential delivery to a ball launch position at the port.

25. The ball injector of claim 24, wherein each of the pistons is pneumatically actuated for sequential ball launch.

26. A ball cartridge assembly as set forth in claim 24.

27. A frac tree including the ball injector of claim 1 connected into the frac tree at a position below a frac head.

* * * * *